US008480210B2

(12) United States Patent
Koseki

(10) Patent No.: US 8,480,210 B2
(45) Date of Patent: Jul. 9, 2013

(54) LIQUID JET HEAD, LIQUID JET APPARATUS, AND MANUFACTURING METHOD FOR THE LIQUID JET HEAD

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 13/134,038

(22) Filed: May 26, 2011

(65) Prior Publication Data

US 2011/0292135 A1 Dec. 1, 2011

(30) Foreign Application Priority Data

May 27, 2010 (JP) ..... 2010-121965

(51) Int. Cl.
*B41J 2/045* (2006.01)

(52) U.S. Cl.
USPC ..... 347/68; 347/69; 347/71; 347/72

(58) Field of Classification Search
USPC ..... 347/68–72
See application file for complete search history.

(56) References Cited

U.S. PATENT DOCUMENTS 5,193,256 A * 3/1993 Ochiai et al. ..... 29/25.35
5,311,218 A * 5/1994 Ochiai et al. ..... 347/71
5,311,219 A * 5/1994 Ochiai et al. ..... 347/68
5,351,375 A * 10/1994 Ochiai et al. ..... 29/25.35
5,560,090 A * 10/1996 Komakine et al. ..... 29/25.35
5,631,680 A * 5/1997 Sugahara ..... 347/69
6,390,609 B1 * 5/2002 Shigemura et al. ..... 347/71
2009/0109263 A1 * 4/2009 Koseki ..... 347/68

FOREIGN PATENT DOCUMENTS

EP 0522814 1/1993
JP 05318741 12/1993
JP 2000108361 4/2000

* cited by examiner

*Primary Examiner* — Matthew Luu
*Assistant Examiner* — Henok Legesse
(74) *Attorney, Agent, or Firm* — Adams & Wilks

(57) ABSTRACT

A liquid jet head is provided with an actuator substrate having grooves spaced apart from one another through an intermediation of partition walls. Drive electrodes are formed on confronting side surfaces of the partition walls so as not to be electrically connected to one another and are configured to be driven independently from one another to independently deform the partition walls. Each of the partition walls has a first portion made of a first material and extending from a base surface of the corresponding groove, and has a second portion extending from the first portion and being made of a second material having a higher permittivity than that of the first material. A cover plate is mounted on the actuator substrate so as to cover the grooves, and a nozzle plate has nozzles communicating with respective ones of the grooves.

8 Claims, 11 Drawing Sheets

First bonding step

Groove forming step

Groove forming step

Conductive film forming step

Electrode forming step

Second bonding step

Oblique deposition step

Oblique deposition step

Electrode forming step

Second bonding step

First bonding step

Photosensitive resin film forming step

Groove forming step

Groove forming step

Pattern forming step

Oblique deposition step

Oblique deposition step

Electrode forming step

Second bonding step

PRIOR ART
FIG.12
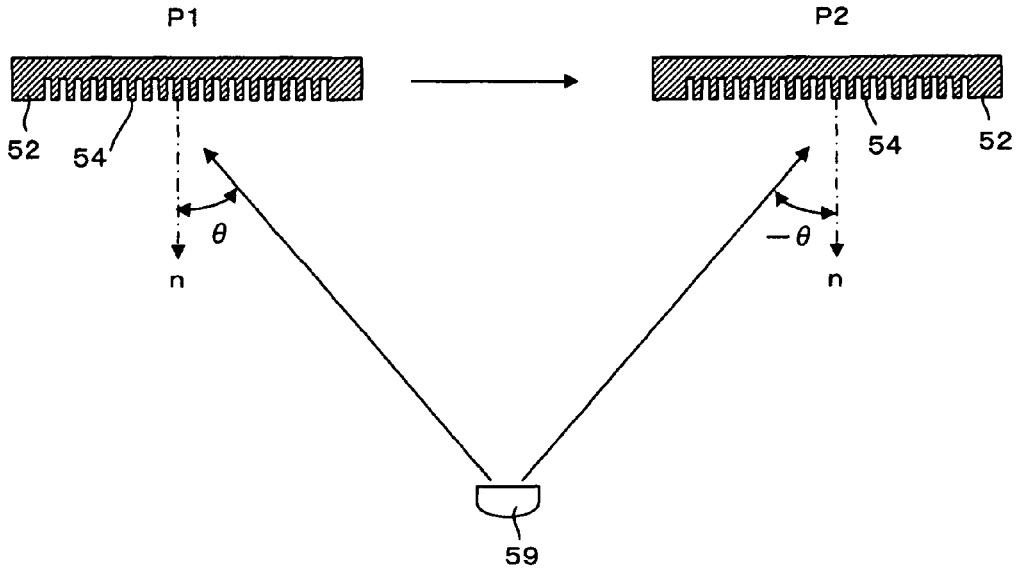
PRIOR ART
FIG.13A
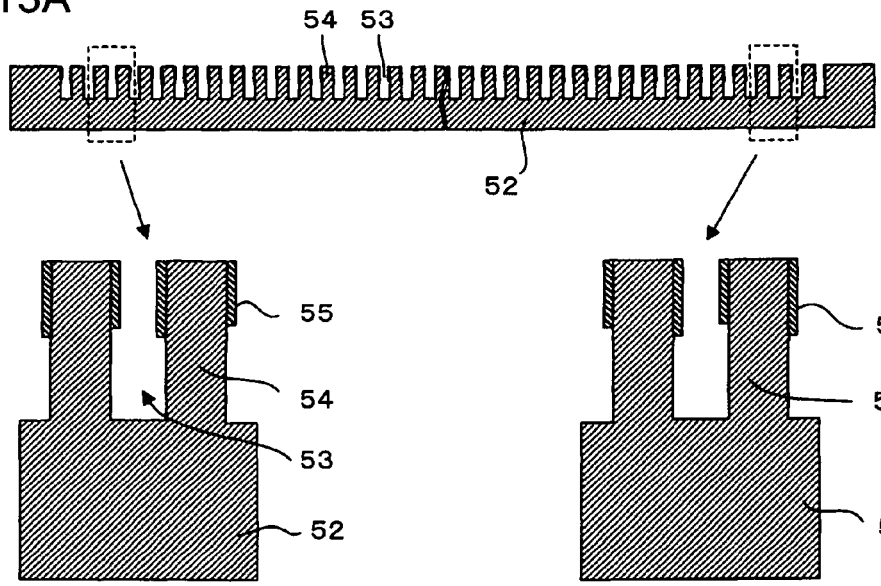
FIG.13B FIG.13C

LIQUID JET HEAD, LIQUID JET APPARATUS, AND MANUFACTURING METHOD FOR THE LIQUID JET HEAD

BACKGROUND OF THE INVENTION

1. Field of the Invention

The present invention relates to a liquid jet head for forming an image, a character, or a thin film material on a recording medium by discharging liquid from a nozzle, and relates to a method of manufacturing the liquid jet head and to a liquid jet apparatus using the liquid jet head.

2. Description of the Related Art

In recent years, there has been used an ink jet type liquid jet head for discharging ink droplets on recording paper or the like to render a character or graphics or for discharging a liquid material on a surface of an element substrate to form a pattern of a functional thin film. In such a liquid jet head, ink or a liquid material is supplied from a liquid tank via a supply tube to the liquid jet head, the ink is caused to fill minute space formed in the liquid jet head, and a capacity of the minute space is momentarily changed according to a drive signal to discharge liquid droplets from a nozzle which communicates to a groove.

FIG. 11 is an exploded perspective view of an ink jet head 51 of this type (FIG. 1 of JP 2000-108361 A). The ink jet head 51 includes: an actuator substrate 52 including a plurality of grooves 53 formed in a surface thereof; a cover plate 56 bonded onto the actuator substrate 52 so as to cover the plurality of grooves 53; a manifold 57 bonded to a rear end of the actuator substrate 52, for supplying ink into the plurality of grooves 53; and a nozzle plate 58 bonded to a front end of the actuator substrate 52, the nozzle plate 58 including nozzles 58*a* for discharging the ink.

The actuator substrate 52 and partition walls 54 are made of a piezoelectric material, and the partition walls 54 are subjected to polarization processing in a normal direction of the substrate surface. Electrodes 55 are respectively formed on both side surfaces of each partition wall 54 so as to sandwich the partition wall 54. By giving a drive signal to the electrodes 55, the partition wall 54 slips to be deformed in a thickness direction, to thereby change internal volumes of the grooves 53. Thus, the ink filled in the grooves 53 is caused to jet from the nozzles 58*a*, and is recorded on the recording medium.

A bending point when the partition wall 54 slips to be deformed in the thickness direction is situated at substantially half a height from a bottom surface of each groove 53 to a top surface of each partition wall 54. With this configuration, it is possible to most efficiently deform and drive the partition wall 54. For that reason, the electrode 55 to be formed on each surface of the partition wall 54 is formed from the bottom surface of the groove 53 to ½ of the height of the partition wall 54, or formed from ½ of the height of the partition wall 54 to the height of the top surface of the partition wall 54. When widths in a depth direction of the electrodes 55 vary in every groove 53, ink discharge performance varies in every nozzle 58*a*. The recording medium, on which ink droplets are jetted, moves. Accordingly, when flying rate of the ink droplets varies, the jetted positions vary, which leads to degradation in printing quality. Therefore, the electrodes 55 to be formed on the side surfaces of the partition walls 54 need to be formed into the same shape in the respective grooves 53.

In JP 2000-108361 A, metal electrodes are formed on the entire surface including the side surfaces of the partition wall 54 and the bottom surface of the groove 53 by electroless plating processing. Then, a laser beam is irradiated from a direction that is oblique in the direction orthogonal to the grooves 53 with respect to the normal of the surface of the actuator substrate 52, and the upper half of the metal electrode formed on one side surface of the partition wall 54 is removed. Next, the upper half of the metal electrode formed on the other side surface is removed by irradiating the laser beam from the opposite oblique direction. If the metal electrodes are to be removed together by irradiating the laser beam to a large area at the time of removal, an incident angle of the laser beam irradiated to the surface differs in every position, and hence the electrodes vary in width. In order to avoid this, it is necessary to irradiate the laser beam to a small area by limiting the irradiation range.

JP 05-318741 A describes another method of forming the electrodes 55. After a plurality of grooves are formed in an actuator substrate made of a piezoelectric material, a target wire is inserted into each of the grooves, the target wire having a diameter substantially equal to the width of each groove. By irradiating an inert gas ion beam from a direction of upper openings of the plurality of grooves, the target wire embedded in each of the grooves is sputtered. In this way, metal particles sputtered from the target wire adhere to upper portions of side wall surfaces. After that, the target wire is taken out of each of the grooves.

As another electrode forming method, there is known an oblique deposition of depositing a conductive material obliquely. FIG. 12 illustrates a method of forming drive electrodes by the oblique deposition on the side surfaces of the partition walls 54 made of the piezoelectric material. The actuator substrate 52 is inserted into a chamber of a vacuum deposition device. First, assuming that an inclination angle θ is formed between an evaporation source 59 and a normal direction n of the surface on which the partition walls 54 are formed, the actuator substrate 52 is placed so that the evaporation source 59 is substantially orthogonal to a longitudinal direction of the partition walls 54 (position P1). Then, metal, for example, aluminum is deposited from the evaporation source 59 onto one side surface of each of the partition walls 54. Next, the actuator substrate 52 is placed so that the evaporation source 59 forms an inclination angle −θ with respect to the normal direction n (position P2). Then, the metal is deposited from the evaporation source 59 onto the other side surface of each of the partition walls 54. In this way, it is possible to form each electrode 55 on the top surface side situated above substantially half the height of the partition wall 54.

The electrodes 55 which are formed on the side surfaces of the partition walls 54 need to be formed into the same shape in the respective partition walls 54. In JP 2000-108361 A, in order to form the electrodes 55 into the same shape, the laser beam needs to be irradiated to every side surface of each of the partition walls 54, which requires a greater amount of time for patterning the electrodes 55 as the number of the grooves 53 of the ink jet head increases. Consequently, mass production performance is reduced. Further, a metal material is scattered to the surroundings through irradiation of the laser beam, and the scattered metal material adheres to the grooves 53 again to cause a short circuit and clogging of the nozzles. Further, in the method described in JP 05-318741 A, it is necessary to embed a large number of target wires into a large number of the narrow grooves 53, respectively, the target wires each having a diameter substantially equal to the width of the groove 53. Thus, the mass production performance is low, and the method is not realistic.

FIGS. 13A to 13C are sectional schematic views of the actuator substrate 52 in which the electrodes 55 are formed on the side surfaces of the partition walls 54 by the method illustrated in FIG. 12. FIG. 13A is an overall view of the actuator substrate 52, and FIGS. 13B and 13C are partial sectional views respectively illustrating the left and right sides of the actuator substrate 52. At a left end portion of the actuator substrate 52, the electrodes 55 formed on the side surfaces of each partition wall 54 are formed deeper on the left side surface than on the right side surface. Further, at a right end portion of the actuator substrate 52, the electrodes 55 formed on the side surfaces of each partition wall 54 are formed deeper on the right side surface than on the left side surface. This is because the direction of the evaporation source 59, that is, the inclination angle θ changes depending on the position of the surface of the actuator substrate 52. In other words, at a position near the evaporation source 59, the inclination angle θ is small and the electrode 55 is formed on a deeper portion of the side surface, whereas at a position distant from the evaporation source 59, the inclination angle θ is large and the electrode 55 is formed on a shallower portion of the side surface.

As described above, the electrodes 55 formed on the partition walls 54 differ in depth depending on the position of the surface of the actuator substrate 52. FIG. 14 shows a relation between a nozzle No (nozzle position) and liquid droplet discharge rate (relative value) of the ink jet head when the electrodes 55 are formed by the oblique deposition illustrated in FIGS. 13A to 13C. As shown in FIG. 14, the nozzles situated at the center portion have higher liquid droplet discharge rate than the nozzles situated at the peripheral portion. This is because an electric field is applied more efficiently to the partition walls 54 situated at the center portion than those situated at the peripheral portion. However, such variations in liquid droplet discharge rate cause degradation in printing quality.

Specific description is made with reference to FIGS. 15A to 15D and FIGS. 16A and 16B. FIGS. 15A to 15D are sectional schematic views of a discharge channel formed by the groove 53 formed in the actuator substrate 52 and by the cover plate 56 bonded onto the top surface of the actuator substrate. In FIGS. 15A to 15D and FIGS. 16A and 16B, the partition walls 54 are made of the piezoelectric material, and are uniformly subjected to polarization processing in a perpendicular direction (height direction of the partition walls 54). FIGS. 15A and 15B illustrate a case where the electrode 55 is formed on each side surface on an upper side situated above substantially half a height h of the partition wall 54, and FIGS. 15C and 15D illustrate a case where the electrode 55 is formed to extend over a lower side situated below substantially half the height h of the partition wall 54.

As illustrated in FIG. 15A, when a voltage is applied to terminals Ta and Tb, the electric field is applied in the thickness direction of the partition walls 54. Then, slip stress (shear stress) S is generated on the surface of each partition wall 54 on the electrode 55 side to bend the center portion of the partition wall 54 to an outer side Ou. In addition, when a polarity of the applied voltage is reversed, as illustrated in FIG. 15B, the direction of the slip stress S is reversed so that the center portion of the partition wall 54 is bent to an inner side In. In this way, by deforming and driving the partition walls 54, the ink filling a discharge channel C is discharged from the nozzle 58*a*.

Next, description is made of the case where the electrodes 55 extend across the center portion of the partition wall 54 over the lower side thereof. In FIG. 15C, by applying the voltage to the terminals Ta and Tb, the electric field is applied to the partition walls 54. Then, similarly to the case of FIG. 15A, the slip stress S is generated at the upper half of each partition wall 54, to thereby bend the partition wall 54 to the outer side Ou. Meanwhile, the slip stress generated in an electric field application region on the lower side of the partition wall 54 attempts to bend the partition wall 54 to the inner side In. Therefore, a force of bending the partition wall 54 to the outer side Ou is reduced, with the result that a deformation amount of the partition wall 54 is reduced and power consumption is increased. When the polarity of the applied voltage is reversed, as illustrated in FIG. 15D, the direction of the slip stress S is reversed to attempt to bend the center portion of the partition wall 54 to the inner side In at the upper half of the partition wall 54. However, the slip stress generated on the lower side of the partition wall 54 attempts to bend the partition wall 54 to the outer side Ou, and hence similarly to the case of FIG. 15C, the deformation amount of the partition wall 54 is reduced and the power consumption is increased.

FIGS. 16A and 16B are sectional schematic views of the actuator substrate 52, and illustrate shapes of the electrodes 55 with respect to positions of the partition walls 54. FIG. 16A illustrates a case where all the electrodes 55 are formed on the upper side situated above the upper halves (½) h of the partition walls 54, and FIG. 16B illustrates a case where all the electrodes 55 are formed to extend over the lower halves of the partition walls 54. As illustrated in FIG. 16A, among the electrodes 55 to be formed on the left side surfaces of the respective partition walls 54, the electrode 55 of the partition wall 54 situated at the left end portion is deepest, and the electrodes 55 become gradually shallower toward the right end portion. Meanwhile, among the electrodes 55 to be formed on the right side surfaces of the respective partition walls 54, the electrode 55 of the partition wall 54 situated at the left end portion is shallowest, and the electrodes 55 become gradually deeper toward the right end portion. As a result, an area of an upper half of each electric field application region Sa, in which the right and left electrodes 55 overlap each partition wall 54, becomes widest at the center portion of the actuator substrate 52 and becomes narrower toward both end portions of the actuator substrate 52. It can be understood that, because the areas of the electric field application regions Sa change depending on the positions of the partition walls 54, the discharge rate becomes highest at the center portion as shown in FIG. 14, and becomes lower toward both the end portions.

In the case where the electrodes 55 extend over the lower halves of the partition walls 54, as illustrated in FIG. 16B, the areas of the electric field application regions Sa at the upper halves of the partition walls 54 are constant, whereas electric field application regions Sb at the lower halves thereof become widest at the center portion, and become narrower toward the peripheral portion. In other words, the slip stress at the upper halves of the partition walls 54 is equal among the respective partition walls 54, whereas the slip stress at the lower halves thereof, which functions as a brake with respect to deformation of the partition walls 54 resulting from the above-mentioned stress, is highest at the center portion of the actuator substrate 52, and gradually decreases toward the peripheral portion. Thus, even in the case of FIG. 16B, discharge rate of the ink droplets discharged from the nozzles 58*a* is not constant. In addition, deformation drive of the partition walls 54 is accelerated and decelerated at the same time, and hence energy is consumed wastefully. In the actual actuator substrate 52 illustrated in FIGS. 13A and 13B, in order to prevent the electrodes 55 from ranging in the depth direction at the time of oblique deposition, and prevent the electrodes 55 from being deposited on the lower side than the height h/2 and functioning as the brake at the time of deformation drive of the partition walls 54, all the electrodes 55 to be formed on the side surfaces of the partition walls 54 are formed on the upper side than the height h/2.

As described above, in the actuator substrate 52 that is uniformly polarized in an upright direction of the partition walls 54, if the areas of the electric field application regions are not constant in the respective partition walls 54, it is impossible to ensure equality of the discharge rate. Further, in order to increase electrostrictive efficiency, and to lower the applied voltage so as to reduce load applied to the drive circuit side, it is necessary that each electrode 55 does not extend over a portion situated below the height h/2 of the partition wall 54 in the depth direction, and that the upper half of the electric field application region Sa is formed as wide as possible. Thus, it has been extremely difficult to form the electrode.

SUMMARY OF THE INVENTION

The present invention has been made in view of the above-mentioned circumstances, and an object of the present invention is therefore to provide a liquid jet head which is capable of minimizing variations in discharge performance among all the channels, and which is excellent in discharge efficiency.

A liquid jet head according to the present invention includes: an actuator substrate including: a plurality of grooves aligned in parallel to each other in a surface thereof; partition walls separating the plurality of adjacent grooves from each other; and drive electrodes placed on both side surfaces of each of the partition walls; a cover plate bonded onto the surface of the actuator substrate so as to cover the plurality of grooves; and a nozzle plate including nozzles communicating to the plurality of grooves, the nozzle plate being bonded onto an end surface of the actuator substrate, in which the actuator substrate includes a drive region for driving the partition walls so as to deform the partition walls, and for causing liquid filling the plurality of grooves to jet from the nozzles, in which, in the drive region, each of the partition walls is made of a piezoelectric material on a top surface side situated above substantially half a height from a bottom surface of each of the plurality of grooves to a top surface of each of the partition walls, and made of a low-permittivity material, which is lower in permittivity than the piezoelectric material, on a bottom surface side situated below substantially half the height, and in which, in the drive region, each of the drive electrodes is placed so as to extend across each side surface of each of the partition walls made of the piezoelectric material and each side surface of each of the partition walls made of the low-permittivity material.

Further, in the liquid jet head according to the present invention, the drive electrodes are shaped so that ranges, in which the drive electrodes are formed on the plurality of partition walls made of the low-permittivity material, gradually change from one end to another end of the actuator substrate.

Further, in the liquid jet head according to the present invention, the actuator substrate has a double-layer structure made of the low-permittivity material and the piezoelectric material.

Further, in the liquid jet head according to the present invention, the low-permittivity material is higher in thermal conductivity than the piezoelectric material.

Further, in the liquid jet head according to the present invention, the low-permittivity material is lower in mechanical rigidity than the piezoelectric material.

Further, in the liquid jet head according to the present invention, the low-permittivity material is one of a machinable ceramics and a resin material.

A liquid jet apparatus according to the present invention includes: the liquid jet head according to any aspects described above; a moving mechanism for reciprocating the liquid jet head; a liquid supply tube for supplying liquid to the liquid jet head; and a liquid tank for supplying the liquid to the liquid supply tube.

A manufacturing method for a liquid jet head according to the present invention includes: a first bonding step of bonding a piezoelectric substrate onto a surface of a low-permittivity substrate, to thereby form an actuator substrate, the piezoelectric substrate being made of a piezoelectric material, the low-permittivity substrate being made of a low-permittivity material which is lower in permittivity than the piezoelectric material; a groove forming step of forming a plurality of grooves aligned in parallel to each other in a surface of the actuator substrate, and forming partition walls separating the plurality of adjacent grooves from each other, each of the partition walls being made of the piezoelectric material on a top surface side situated above substantially half a height from a bottom surface of each of the plurality of grooves to a top surface of each of the partition walls, and made of the low-permittivity material on a bottom surface side situated below substantially half the height; a conductive film forming step of forming a conductive film on the surface of the actuator substrate and the partition walls in the drive region so that the conductive film extends across each side surface of each of the partition walls made of the piezoelectric material and each side surface of each of the partition walls made of the low-permittivity material, the drive region causing liquid filling the plurality of grooves to jet; an electrode forming step of forming a pattern of the conductive film; and a second bonding step of bonding a cover plate onto the surface of the actuator substrate, and bonding a nozzle plate onto an end surface of the actuator substrate, the nozzle plate including nozzles communicating to the plurality of grooves.

Further, in the manufacturing method for a liquid jet head according to the present invention, the conductive film forming step includes a step of depositing a conductive material by sputtering.

Further, in the manufacturing method for a liquid jet head according to the present invention, the conductive film forming step includes an oblique deposition step of depositing a conductive material obliquely on the surface of the actuator substrate from a direction oblique to a normal of the surface of the actuator substrate.

Further, the manufacturing method for a liquid jet head according the present invention, further includes: a photosensitive resin film forming step of forming a photosensitive resin film on the surface of the actuator substrate after performing the first bonding step; and a pattern forming step of forming a pattern of the photosensitive resin film through exposure and development of the photosensitive resin film before performing the conductive film forming step, in which, in the electrode forming step, the pattern of the conductive film is formed by a lift-off method in which the photosensitive resin film is removed.

A liquid jet head according to the present invention includes: an actuator substrate including: a plurality of grooves aligned in parallel to each other in a surface thereof; partition walls separating the plurality of adjacent grooves from each other; and drive electrodes placed on both side surfaces of each of the partition walls; a cover plate bonded onto the surface of the actuator substrate so as to cover the plurality of grooves; and a nozzle plate including nozzles communicating to the plurality of grooves, the nozzle plate being bonded onto an end surface of the actuator substrate, in which the actuator substrate includes a drive region for driving the partition walls so as to deform the partition walls, and for causing liquid filling the plurality of grooves to jet from the nozzles, in which, in the drive region, each of the partition walls is made of a piezoelectric material on a top surface side situated above substantially half a height from a bottom surface of each of the plurality of grooves to a top surface of each of the partition walls, and made of a low-permittivity material, which is lower in permittivity than the piezoelectric material, on a bottom surface side situated below substantially half the height, and in which, in the drive region, each of the drive electrodes is placed so as to extend across each side surface of each of the partition walls made of the piezoelectric material and each side surface of each of the partition walls made of the low-permittivity material. As described above, a drive section for the partition walls is arranged above substantially half the height of each of the partition walls, and the drive electrodes are formed so as to extend across the piezoelectric material side of the partition walls and the low-permittivity material side. Thus, deformation drive amounts of the respective partition walls are equalized, and it is possible to reduce variations in liquid droplet discharge rate among the nozzles. In addition, the low-permittivity material is interposed between one partition wall and another adjacent partition wall, and hence capacitive coupling is reduced. Thus, a drive signal can be prevented from leaking to the adjacent partition walls and fluctuating liquid droplet discharge characteristics of the adjacent nozzles. In addition, the drive electrodes do not need to be formed with high accuracy so as to align at bending positions of the partition walls, and hence it is extremely easy to form the electrodes.

BRIEF DESCRIPTION OF THE DRAWINGS

In the accompanying drawings:

FIG. 12 is a schematic view illustrating an electrode forming method for a conventionally known ink jet head;

FIGS. 13A to 13C are partial sectional views of partition walls of the conventionally known ink jet head;

DETAILED DESCRIPTION OF THE PREFERRED EMBODIMENTS

Figure 1:
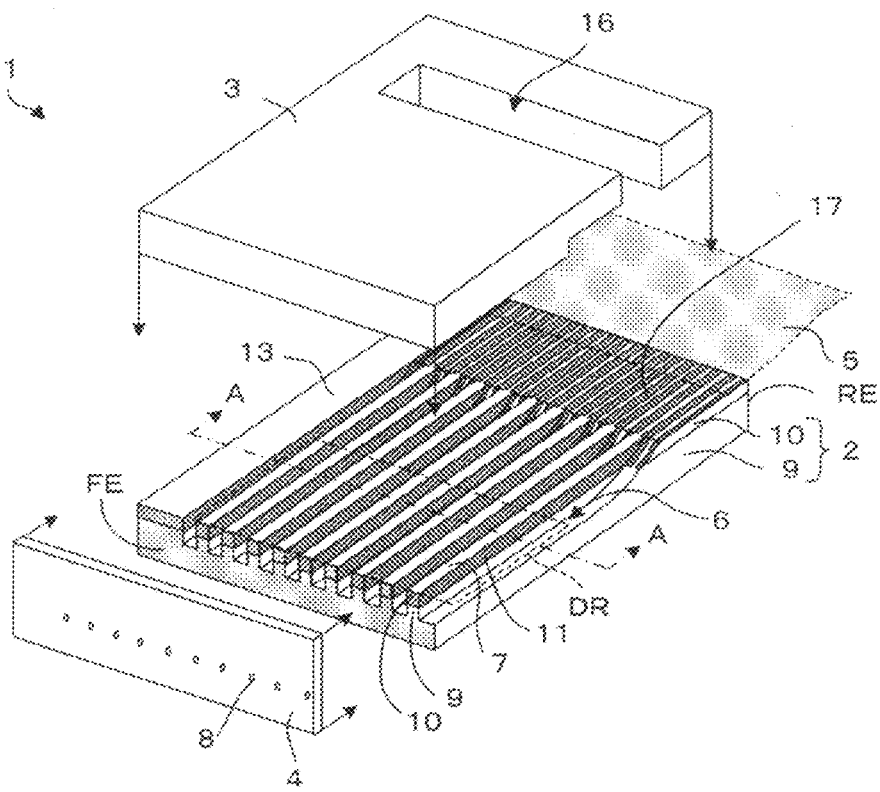
FIG. 1 is a partial exploded perspective view of a liquid jet head according to a first embodiment of the present invention.

A liquid jet head according to the present invention includes: an actuator substrate including a plurality of grooves separated from each other by partition walls, and including drive electrodes placed on both side surfaces of each of the partition walls; a cover plate bonded onto the actuator substrate so as to cover the respective grooves; and a nozzle plate including nozzles communicating to the respective grooves, the nozzle plate being bonded onto an end surface of the actuator substrate. The actuator substrate includes a drive region for driving the partition walls so as to deform the same, and for causing liquid filling the grooves to jet from the nozzles. Each partition wall in the drive region is made of a piezoelectric material on a top surface side situated above substantially half a height of the partition wall, and made of a low-permittivity material, which is lower in permittivity than the piezoelectric material, on a groove bottom surface side situated below substantially half the height. Further, each drive electrode in the drive region is placed so as to extend across each side surface of the partition wall made of the piezoelectric material and each side surface of the partition wall made of the low-permittivity material.

With this configuration, the partition wall is made of the low-permittivity material on the bottom surface side situated below substantially half the height, and hence the bottom surface side does not exhibit an electrostrictive effect even when the electric field is applied thereto. Thus, deformation drive amounts of the respective partition walls are equalized, and it is possible to reduce variations in liquid droplet discharge rate among the nozzles. In addition, the low-permittivity material is interposed between one partition wall and another adjacent partition wall, and hence capacitive coupling is reduced. Owing to the reduction in capacitive coupling, leakage of a drive signal between the adjacent partition walls is reduced, with the result that liquid discharge characteristics cannot be affected by drive states of the adjacent channels. In addition, each drive electrode in the drive region only needs to be formed to extend across each side surface of the partition wall made of the piezoelectric material and each side surface of the partition wall made of the low-permittivity material situated below the piezoelectric material, and an extending amount does not affect the deformation drive amount of the partition wall. Thus, the electrode forming method is extremely simplified.

Lead zirconate titanate (PZT), barium titanate ($BaTiO_3$), or the like can be used as the piezoelectric material. The piezoelectric material is subjected to polarization processing in advance in a specific direction, for example, a normal direction of the surface of the actuator substrate. A glass material, a metal oxide, a ceramics, a machinable ceramics, a resin material, or the like can be used as the low-permittivity material. In a case of using PZT as the piezoelectric material, a half or less of an amount of PZT can be used when compared to the case of the conventional method, and hence it is possible to remarkably reduce an amount of lead to be used. In a case of using, for example, the machinable ceramics as the low-permittivity material, the machinable ceramics is excellent in processability, and hence the grooves can be formed easily at once in the machinable ceramics and the piezoelectric material bonded onto the surface of the machinable ceramics. By approximating coefficients of thermal expansion of the piezoelectric material and the low-permittivity material to each other, it is possible to improve reliability of bonding. In a case of using, for example, the resin material as the low-permittivity material, the resin material is excellent in processability and die moldability, and hence it is possible to easily form a complex shape. In this case, the resin material can be used also for the cover plate which is bonded onto a top surface of the actuator substrate, and hence it is possible to remarkably reduce manufacturing cost. Further, when using a material higher in thermal conductivity than the piezoelectric material as the low-permittivity material, it is possible to further improve a heat radiation effect of heat generated by deformation drive of the partition walls. Further, mechanical rigidity of the low-permittivity material, for example, Young's modulus thereof can be made smaller than that of the piezoelectric material. Thus, it is possible to deform and drive the partition walls at lower voltage.

A manufacturing method for a liquid jet head according to the present invention includes: a first bonding step of bonding a piezoelectric substrate onto a surface of a low-permittivity substrate, to thereby form an actuator substrate; a groove forming step of forming a plurality of grooves aligned in parallel to each other in a surface of the actuator substrate, and forming partition walls separating the plurality of grooves from each other, each of the partition walls being made of a piezoelectric material on a top surface side situated above substantially half a height from a bottom surface of each of the grooves to the top surface of each of the partition walls, and made of a low-permittivity material on the bottom surface side situated below substantially half the height; a conductive film forming step of forming a conductive film on the surface of the actuator substrate and the partition walls in the drive region so that the conductive film extends across each side surface of each of the partition walls made of the piezoelectric material and each side surface of each of the partition walls made of the low-permittivity material; an electrode forming step of forming a pattern of the conductive film; and a second bonding step of bonding a cover plate onto the surface of the actuator substrate, and bonding a nozzle plate onto an end surface of the actuator substrate.

According to the manufacturing method, each of the partition walls is made of the low-permittivity material on the bottom surface side situated below substantially half the height of the partition wall, and hence the bottom surface side does not exhibit the electrostrictive effect even when the electric field is applied thereto. Accordingly, even when the drive electrode extends over the bottom surface side situated below substantially half the height of the partition wall, the extending drive electrode does not affect the deformation drive of the partition wall, and does not affect the discharge rate of liquid droplets discharged from the nozzles. With this, there is remarkably eased strictness required for pattern formation accuracy of an electrode pattern which is formed on the side surfaces of the partition walls in the conductive film forming step or the electrode forming step. As an electrode forming method, for example, sputtering, deposition, oblique deposition, or plating can be used. In addition, the low-permittivity material is interposed between one partition wall and another adjacent partition wall, and hence it is possible to reduce leakage of the drive signal.

Further, the manufacturing method may further include a photosensitive resin film forming step of forming a photosensitive resin film on the surface of the actuator substrate after performing the bonding step, and include a pattern forming step of forming a pattern through exposure and development of the photosensitive resin film before performing the conductive film forming step. Further, in the electrode forming step, a pattern of the conductive film can be formed by a lift-off method in which the photosensitive resin film is removed to form the above-mentioned pattern. In this way, it is possible to easily form an electrode pattern on the surface of the actuator substrate and the top surface of each partition wall. Hereinafter, specific description of the present invention is made with reference to the drawings.

First Embodiment

Figure 2A:
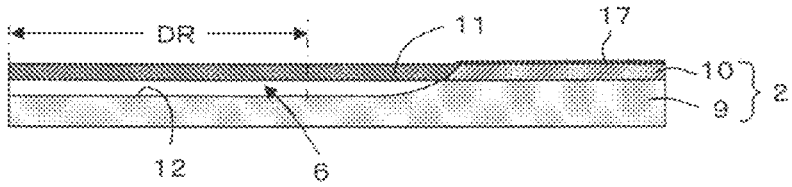
FIGS. 2A to 2D are explanatory diagrams of an actuator substrate according to the first embodiment of the present invention.
Figure 2B:
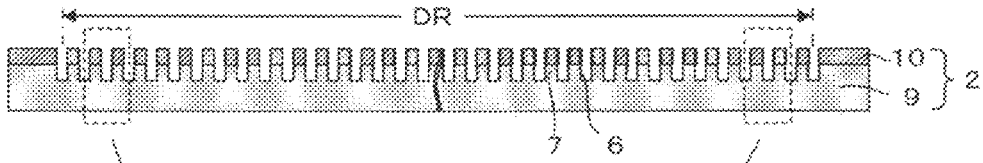
Figure 2C:
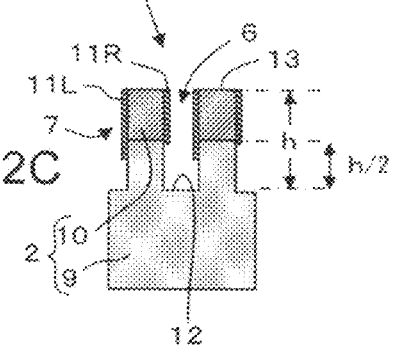
Figure 2D:
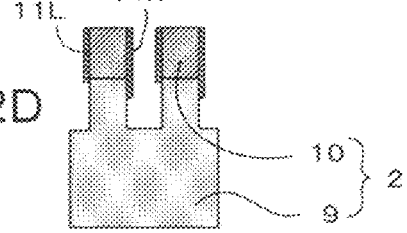

FIG. 1 is a partial exploded perspective view of a liquid jet head 1 according to a first embodiment of the present invention, and a side surface on a front side illustrates a vertical cross-section along grooves 6. FIGS. 2A to 2D are explanatory diagrams of an actuator substrate 2 to be used in the first embodiment. FIG. 2A is a vertical sectional schematic view taken along a direction of the grooves 6, FIG. 2B is a vertical sectional schematic view of a part AA, and FIGS. 2C and 2D are partial enlarged views illustrating a left side and a right side of the vertical cross-section of the part AA.

The liquid jet head 1 includes the actuator substrate 2, a cover plate 3 bonded on the actuator substrate 2, and a nozzle plate 4 bonded to end surfaces of the actuator substrate 2 and the cover plate 3 at front ends FE thereof. The actuator substrate 2 has a configuration in which an upper substrate made of a piezoelectric material 10 is pasted on a lower substrate made of a low-permittivity material 9. A surface of the actuator substrate 2 on the cover plate 3 side includes the plurality of grooves 6 formed in parallel from the front end FE to some midpoint between the front end FE and a rear end RE, and includes a plurality of partition walls 7 separating the respective grooves 6.

As illustrated in FIGS. 2A to 2D, each of the grooves 6 is made of the piezoelectric material 10 on a top surface side (second portion of partition wall 7) situated above substantially half a height h from a bottom surface 12 of the groove 6 to a top surface 13 of the partition wall 7, and made of the low-permittivity material 9, which is lower in permittivity than the piezoelectric material 10, on the bottom surface side (first portion of partition wall 7) situated below substantially half the height h. Both side surfaces of the partition wall 7 respectively include drive electrodes 11L and 11R for driving the partition wall 7 so as to deform the same. By this construction, confronting side surfaces of each pair of adjacent partition walls 7 are provided with confronting drive electrodes 11R, 11L which are not electrically connected to one another, as can be seen from FIGS. 2B-2D in which the drive electrodes are not formed on bottom surfaces 12 of the groove 6. Each of the drive electrodes 11 covers at least the entire side surface made of the piezoelectric material 10. As illustrated in FIG. 2A, the drive electrode 11 formed on each side surface of the partition wall 7 is electrically connected to a terminal electrode 17 formed on a surface at the vicinity of the rear end RE of the actuator substrate 2, and electrically connected to a wiring electrode (not shown) of a flexible substrate 5 bonded to the top surface at the rear end RE of the actuator substrate 2.

The cover plate 3 includes a liquid supply hole 16 through which liquid is supplied into the respective grooves 6. The nozzle plate 4 includes nozzles 8 which communicate to channels formed by the cover plate 3 and the grooves 6, and is bonded on the end surfaces of the actuator substrate 2 and the cover plate 3 at the front ends FE thereof. A drive signal generated by a drive circuit (not shown) is given to the drive electrodes 11L and 11R formed on both the side surfaces of the partition walls 7 through the wiring electrode (not shown) of the flexible substrate 5. The partition walls 7 are deformed according to the drive signal, to thereby change internal volumes of the grooves 6. In this way, liquid filling the channels is discharged from the nozzles 8 as liquid droplets.

Specifically, the top surfaces 13 of the partition walls 7 are bonded and fixed to the cover plate 3 at a region ranging from the front end FE to the liquid supply hole 16, and hence the partition walls 7 are deformed. The region to be deformed is referred to as a drive region DR. First, deformation of the piezoelectric material 10 as a substantially upper half of the partition wall 7 is described. When a drive voltage is applied to the piezoelectric material 10 of the partition wall 7 through the drive electrodes 11, the cross-section of the piezoelectric material 10 is deformed from a substantially rectangular shape into a substantially parallelogram shape. In this case, because the above-mentioned top surface 13 is fixed to the cover plate 3, under a state in which the top surface 13 remains fixed, the piezoelectric material 10 is deformed into a substantially parallelogram shape in which the top surface 13 serves as an upper side and a portion bonded to the low-permittivity material 9 serves as a lower side. Next, deformation of the low-permittivity material 9 as a substantially lower half of the partition wall 7 is described. Unlike the above-mentioned deformation of the piezoelectric material 10, piezoelectric deformation does not occur in the low-permittivity material 9, and hence the low-permittivity material 9 is deformed following the deformation of the piezoelectric material 10. That is, substantially the center of the partition wall 7 is fixed to the piezoelectric material 10, and hence is deformed following the deformation thereof. However, the lowermost portion of the partition wall 7 is fixed by the low-permittivity material 9, and hence is not deformed. With this, the upper half and the lower half of the partition wall 7 are deformed into a substantially parallelogram shape so as to be vertically symmetric about substantially the center of the partition wall, and hence the partition wall 7 is deformed into a "dogleg shape" in an overall view. The deformation of the partition wall 7 changes the internal volumes of the grooves 6, and as described above, liquid filling the channels is discharged from the nozzles 8 as liquid droplets.

Note that, the drive region DR is normally set to a region in which the depth of each of the grooves 6 is deep and the bottom surface 12 thereof is flat. Therefore, a "height of the partition wall in the drive region from the top surface to the bottom surface of the groove" refers to a height from the flat bottom surface 12 of each of the grooves 6 to the top surface 13, that is, the height h at which the partition wall 7 becomes highest. However, the drive region DR may sometimes extend to a region in which the bottom surface 12 of each of the grooves 6 is inclined, or formed into an arc shape with a trace of a shape of a dicing blade. In this case, the "height of the partition wall in the drive region from the bottom surface of the groove to the top surface" refers to the height excluding the region in which the bottom surface 12 of each of the grooves 6 is inclined and the region in which there is the trace of an arc shape, that is, the height h, at which the partition wall 7 becomes highest, from the flat bottom surface 12 of each of the grooves 6 to the top surface 13.

Next, the shapes of the partition walls 7 and the shapes of the drive electrodes 11 are described. As described in detail below, the drive electrodes 11 are formed by depositing a conductive material by oblique deposition. Thus, depending on the positions of the grooves 6 with respect to an evaporation source for the conductive material, widths in a depth direction of the drive electrodes 11 are unequal. As illustrated in FIG. 2C, in the partition walls 7 situated on the left side of the actuator substrate 2, the drive electrodes 11L on the left side surfaces are larger in width in the depth direction than the drive electrodes 11R on the right side surfaces. As illustrated in FIG. 2D, in the partition walls 7 situated on the right side of the actuator substrate 2, the drive electrodes 11R on the right side surfaces are larger in width in the depth direction than the drive electrodes 11L on the left side surfaces. Further, the drive electrodes 11 of each of the partition walls 7 gradually change from the shapes of the drive electrodes 11L and 11R illustrated in FIG. 2C to the shapes of the drive electrodes 11L and 11R illustrated in FIG. 2D. That is, the drive electrodes 11 formed on the side surfaces of each partition wall 7 overlap the entire side surfaces of the piezoelectric material 10 situated above substantially half the height h, whereas the drive electrodes 11 have unequal shapes in the depth direction on the side surfaces of the low-permittivity material 9.

However, the piezoelectric material 10 exhibits an electrostrictive effect. In the drive region DR, the piezoelectric material 10 of each partition wall 7 is arranged at substantially half the height h above the bottom surface 12 of each groove 6. Thus, the point at substantially half the height h serves as a bending point, and hence can most efficiently develop bending deformation with respect to electric field energy. Further, the low-permittivity material 9 is interposed between one partition wall 7 and another adjacent partition wall 7. Thus, there is reduced a leakage signal which is generated when the drive signal given to the specific partition wall 7 leaks to the adjacent partition walls 7 due to capacitive coupling. As a result, the respective partition walls 7 have substantially the same deformation amount when an electric field is applied on the drive electrodes 11L and 11R of the partition walls 7, and an influence of drive of the adjacent partition walls 7 is reduced.

As described above, it is noted that the drive electrodes 11 of each partition wall 7 gradually change from the shape of the drive electrodes 11L and 11R illustrated in FIG. 2C to the shape of the drive electrodes 11L and 11R illustrated in FIG. 2D. More specifically, ranges, in which the drive electrodes on one side of the actuator substrate 2 are formed on the low-permittivity material 9, gradually change from one end to the other end of the actuator substrate 2 (from the left direction to the right direction of the drawing sheet of FIGS. 2B to 2D). Assuming that the drive electrodes 11L illustrated in FIGS. 2C and 2D are the drive electrodes on one side, those shapes can be understood well with reference to FIGS. 3A and 3B and FIGS. 7A, 7B, 7C, and 7D described below, and it is understood that the ranges, in which the drive electrodes 11L are formed on the low-permittivity material 9, change to become gradually smaller.

Similarly, ranges, in which the drive electrodes on the other side of the actuator substrate 2 are formed on the low-permittivity material 9, gradually change from the other end to one end of the actuator substrate 2 (from the right direction to the left direction of the drawing sheet of FIGS. 2B to 2D). Assuming that the drive electrodes 11R illustrated in FIGS. 2C and 2D are the drive electrodes on the other side, those shapes can be understood well with reference to FIGS. 3A and 3B and FIGS. 7A, 7B, 7C, and 7D described below, and it is understood that the ranges in which the drive electrodes 11R are formed on the low-permittivity material 9 change to become gradually smaller.

Figure 3A:
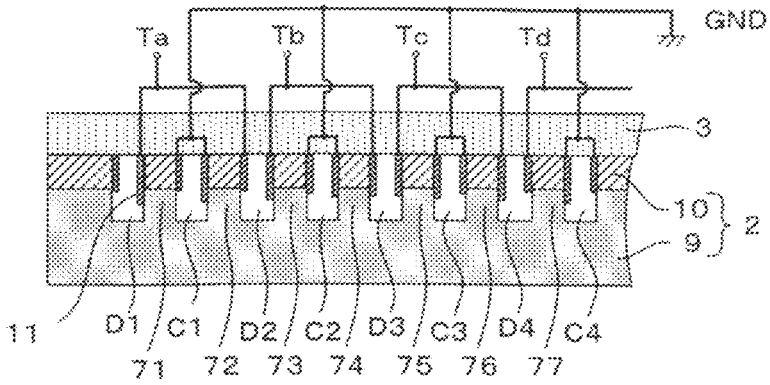
FIGS. 3A and 3B are schematic views of electrode wiring of the liquid jet head according to the first embodiment of the present invention.
Figure 3B:
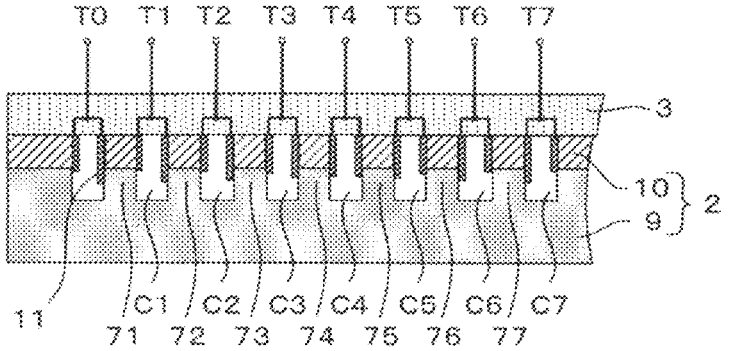

FIGS. 3A and 3B are schematic views illustrating the electrode wiring of the liquid jet head 1 according to the first embodiment. FIG. 3A illustrates the electrode wiring for one-cycle drive, and FIG. 3B illustrates the electrode wiring for three-cycle drive. In the drive region DR, the actuator substrate 2 is made of the piezoelectric material 10 on the cover plate 3 side situated above substantially half the height of each of the partition walls 71 to 77, and made of the low-permittivity material 9 on the bottom surface 12 side situated below substantially half the height thereof. The drive electrodes 11 overlap both the entire side surfaces of the piezoelectric material 10, but have unequal extending widths that extend over the low-permittivity material 9 side.

In FIG. 3A, as the channels formed by the grooves 6 and the cover plate 3, dummy channels D1 to D4 and discharge channels C1 to C4 are alternately arranged. The dummy channels D1 to D4 are not filled with liquid, whereas the discharge channels C1 to C4 are filled with liquid. The drive electrodes 11 formed on both the partition walls of the discharge channels C1 to C4 are connected to a GND mutually. The drive electrodes 11 formed on the side surfaces on the discharge channel side of the dummy channels D1 to D4 adjacent to the discharge channels C1 to C4 are respectively connected to terminals Ta to Td that input the drive signal.

For example, when driving the discharge channel C1, the drive signal is given to the terminal Ta. Then, both the partition walls 71 and 72 are deformed so as to be symmetric about the discharge channel C1, and liquid filling the discharge channel C1 is discharged from the corresponding nozzle 8 of the nozzle plate 4 (not shown). The other discharge channels are driven similarly. In other words, it is possible to simultaneously discharge liquid droplets from the respective discharge channels C1 to C4 at the same timing.

In FIG. 3B, the channels C1 to C7 are filled with liquid. The drive electrodes 11 formed on both the partition walls of the respective channels C1 to C7 are respectively connected to terminal T1 to T7. Then, the channels C1, C4, and C7 are selected at a first cycle timing, the channels C2 and C5 are selected at a second cycle timing, and the channels C3 and C6 are selected at a third cycle timing. Thereafter, the selections are performed repeatedly. For example, when driving the channel C1 at the first timing, the terminal T1 is connected to the GND, and the drive signal is given to terminals T0 and T2. Then, both the partition walls 71 and 72 are deformed so as to be symmetric about the channel C1, and liquid filling the channel C1 is discharged from the corresponding nozzle 8 of the nozzle plate 4 (not shown). When driving the channel C2 at the second cycle timing, the terminal T2 is connected to the GND, and the drive signal is given to terminals T1 and T3. Then, both the partition walls 72 and 73 are deformed so as to be symmetric about the channel C2, and liquid filling the channel C2 is discharged from the corresponding nozzle 8 of the nozzle plate 4 (not shown). Thereafter, driving is performed repeatedly in order of the third cycle, the first cycle . . . .

Under any one of the above-mentioned drive conditions, deformation drive amounts of the partition walls 71 to 77 are equalized, and it is possible to reduce variations in liquid droplet discharge rate among the nozzles. In addition, the low-permittivity material 9 is interposed between one partition wall and another adjacent partition wall, and hence capacitive coupling is reduced. Consequently, the drive signal does not leak to the adjacent partition walls, and liquid discharge characteristics do not fluctuate.

Figure 4:
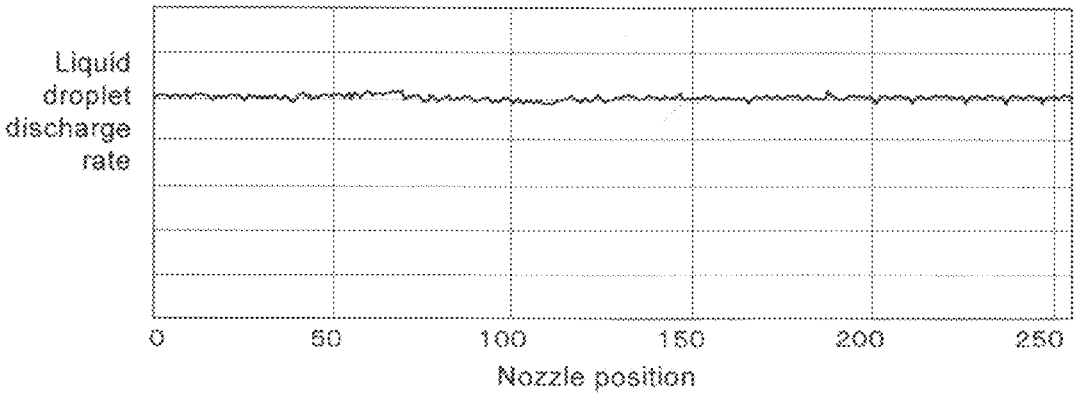
FIG. 4 is a characteristic chart showing a relation between a nozzle position and liquid droplet discharge rate of the liquid jet head according to the first embodiment of the present invention.
Figure 14:
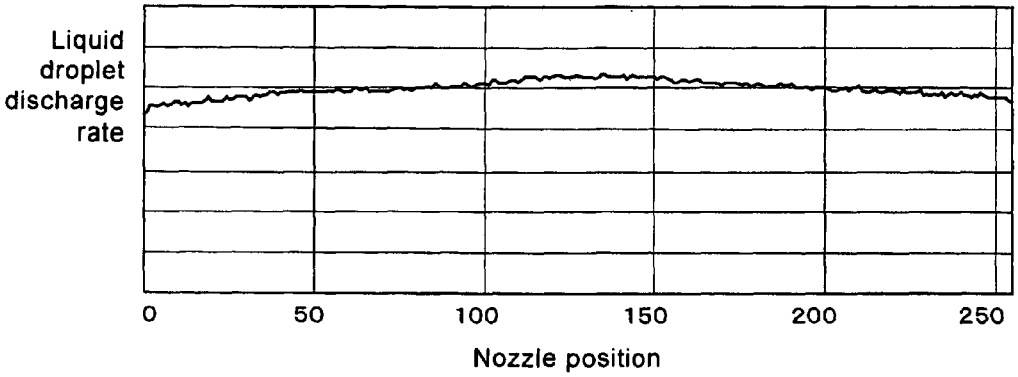
PRIOR ART FIG. 14
FIG. 14 is a characteristic chart showing a relation between a nozzle position and liquid droplet discharge rate of the conventionally known ink jet head.
Figure 15A:
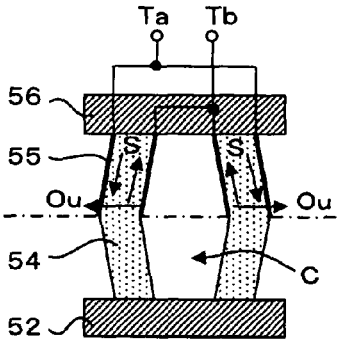
PRIOR ART FIG. 15A
FIGS. 15A to 15D are sectional schematic views illustrating deformation drive of a conventionally known discharge channel.
Figure 15B:
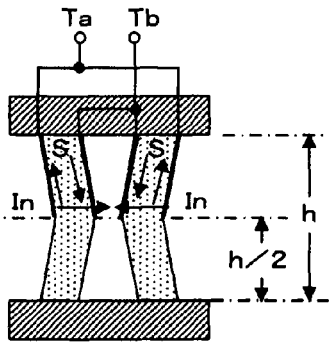
Figure 15C:
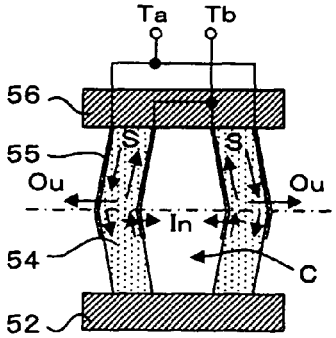
Figure 15D:
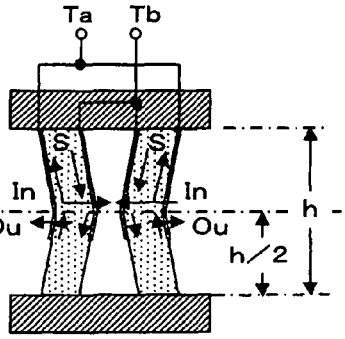
Figure 16A:
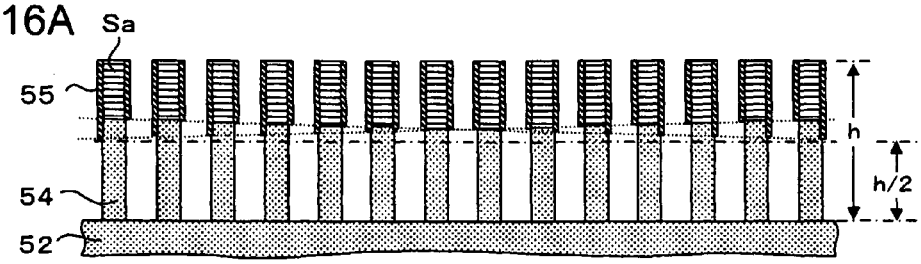
PRIOR ART FIG. 16A
FIGS. 16A and 16B are sectional schematic views of a conventionally known actuator substrate.
Figure 16B:
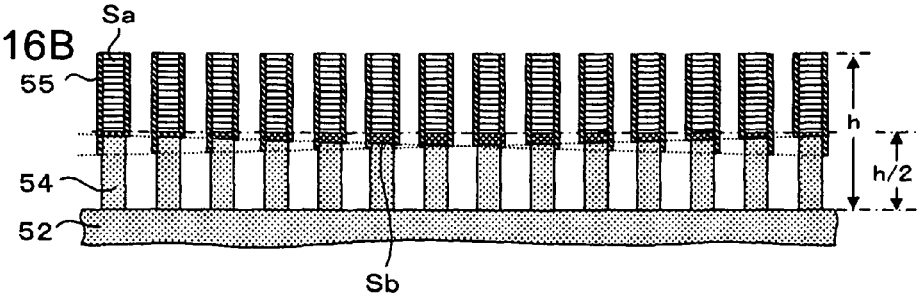

FIG. 4 is a graph showing a relation between liquid droplet discharge rate (relative value) and a nozzle No (nozzle position) of the liquid jet head 1 described in the first embodiment. The vertical axis represents liquid droplet discharge rate, the horizontal axis represents the nozzle No, and the same scale as that of a conventional example illustrated in FIG. 14 is used. In comparison with FIG. 14 showing the conventional example, the liquid droplet discharge rate flattens out with respect to the nozzle No (nozzle position), and it is possible to understand that equality of discharge rate is remarkably improved in comparison with the conventional example illustrated in FIG. 14.

In the first embodiment described above, a PZT ceramics is used as the piezoelectric material 10, and a machinable ceramics is used as the low-permittivity material 9. As the machinable ceramics, for example, Macerite, Macor, Photoveel, Shapal (which are all registered trademarks) may be used. The PZT ceramics has a relative permittivity of 2000 or more, a Young's modulus of 70 GPa to 80 GPa, which indicates rigidity, and a thermal conductivity of 1 W/m·K to 1.5 W/m·K. In contrast, the machinable ceramics may have a relative permittivity of 10 or less (for example, a paraelectric material having a relative permittivity of 5 to 6), and have a Young's modulus of from 50 MPa to less than 70 MPa, and a thermal conductivity of 1.5 W/m·K to 90 W/m·K. With this, it is possible to reduce leakage of the drive signal caused by capacitive coupling between the adjacent partition walls 7 to a negligible level. Further, it is possible to improve heat radiation characteristics. Further, substantially lower halves of the partition walls 7 and the bottom surfaces 12 are made of a low-rigidity material, and hence it is possible to improve deformation efficiency with respect to the electric field. Further, the thermal conductivity is increased, and hence it is possible to improve a heat radiation effect. In addition, though the shapes of the electrodes are different in every partition wall 7, the bending point of each partition wall 7 is situated near a boundary between the low-permittivity material 9 and the piezoelectric material 10, in other words, the bending point is situated at the uniform point, i.e., at substantially half the height h above the bottom surface 12 of the groove 6, and the deformation amount of the partition wall 7 with respect to the electric field is uniform. Consequently, it is possible to reduce variations in liquid droplet discharge rate.

Note that, the method of forming the drive electrodes 11 is not limited to the method of depositing the conductive material by oblique deposition, but may be a method of forming a conductive film by deposition, sputtering, plating, or the like and then patterning the conductive film. For the cover plate 3, a material having a coefficient of thermal expansion nearly equal to that of the piezoelectric material 10 can be used, and, for example, the same material as the piezoelectric material 10 can be used. Further, when an aluminum nitride or an aluminum nitride-based machinable ceramics is used as the low-permittivity material 9, the low-permittivity material 9 has the thermal conductivity that is one digit larger than that of the PZT ceramics, and hence it is possible to effectively cool the piezoelectric material 10 and the grooves 6. Further, when a resin material is used for the low-permittivity material 9 and the cover plate 3, the resin material allows a complex shape to be easily formed by a molding method, and hence it is possible to remarkably reduce manufacturing cost.

Second Embodiment

Figure 5:
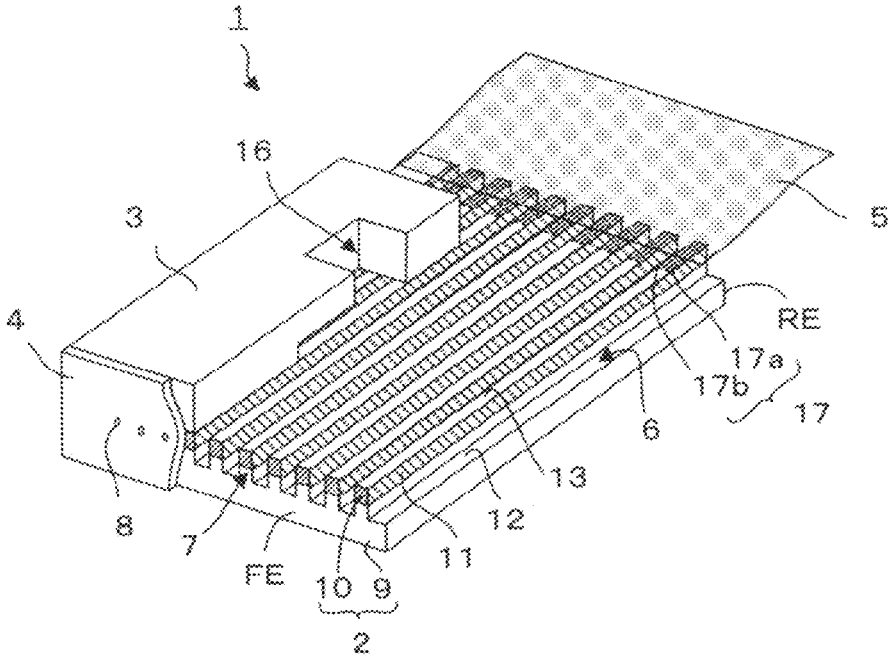
FIG. 5 is a partial exploded perspective view of a liquid jet head according to a second embodiment of the present invention.

FIG. 5 is a schematic partial perspective view of the liquid jet head 1 according to a second embodiment of the present invention. The second embodiment is different from the first embodiment in that the plurality of grooves 6 formed in the surface of the actuator substrate 2 extend from the front end FE up to the rear end RE. The same portions and the portions having the same function are denoted by the same reference symbols.

The liquid jet head 1 includes the actuator substrate 2, the cover plate 3 bonded on the actuator substrate 2, and the nozzle plate 4 bonded to the end surfaces of the actuator substrate 2 and the cover plate 3 at the front ends FE thereof. The actuator substrate 2 has a configuration in which the upper substrate made of the piezoelectric material 10 is pasted on the lower substrate made of the low-permittivity material 9. The surface of the actuator substrate 2 includes the plurality of grooves 6 formed from the front end FE up to the rear end RE, and includes the plurality of partition walls 7 separating the grooves 6. Each of the grooves 6 is made of the piezoelectric material 10 on the top surface 13 side situated above substantially half the height h from the bottom surface 12 of the groove 6 to the top surface 13 of the partition wall 7, and made of the low-permittivity material 9 on the bottom surface 12 side situated below substantially half the height h.

Both of the side surfaces of the partition wall 7 respectively include the drive electrodes 11 for driving the partition wall 7 so as to deform the same. Each of the drive electrodes 11 overlaps at least the entire side surface of the piezoelectric material 10 on the channel side. The drive electrodes 11 of each partition wall 7 are connected to the terminal electrodes 17 formed on the top surface 13 of the partition wall 7 at the vicinity of the rear end RE. That is, the drive electrode 11 formed on one side surface of the partition wall 7 is electrically connected to a terminal electrode 17*a* formed on the top surface 13 on the one side surface side, and the drive electrode 11 formed on the other side surface is electrically connected to a terminal electrode 17*b* formed on the top surface 13 on the other side surface side. The terminal electrodes 17*a* and 17*b* formed at the vicinity of the rear end RE are electrically connected to the wiring electrode (not shown) of the flexible substrate 5 bonded to the top surface at the rear end RE of the actuator substrate 2.

The cover plate 3 includes the liquid supply hole 16 through which liquid is supplied into the grooves 6, and the cover plate 3 is bonded to the surface of the actuator substrate 2 so as to cover the surface from the front end FE to before the rear end RE. The respective grooves 6 are sealed by a sealing material (not shown) on the rear end RE side with respect to the liquid supply hole 16. With this configuration, the liquid supplied from the liquid supply hole 16 into the grooves 6 does not flow out to the rear end RE side through the grooves 6. The nozzle plate 4 includes the nozzles 8 which communicate to the channels formed by the cover plate 3 and the grooves 6, and is bonded on the end surface at the front end FE of the cover plate 3.

In this way, the grooves 6 are formed straight in parallel with one another from the front end FE to the rear end RE, and hence it is possible to eliminate slanted portions of the bottom surfaces 12 of the grooves 6, and to achieve downsizing of the actuator substrate 2. Here, the drive region DR is situated on the front end FE side with respect to the liquid supply hole 16 of the cover plate 3. Also in this embodiment, the adjacent partition walls 7 are fixed through the low-permittivity material 9, and hence a leakage electric field caused by capacitive coupling is reduced, with the result that the partition walls 7 can be driven without being influenced by the drive signal supplied to the adjacent partition walls. Further, in all of the partition walls 7 in the drive region DR, the drive electrodes 11 overlap at least the entire side surfaces made of the piezoelectric material 10, and hence the respective partition walls 7 have substantially the same deformation amount at the time of driving. As a result, discharge rate of liquid droplets discharged from the nozzles 8 at the time of driving is equalized in the respective channels.

It is noted that there may be adopted such a configuration that the cover plate 3 is bonded so as to cover the plurality of grooves 6 of the actuator substrate 2 without providing the liquid supply hole 16 in the cover plate 3, and a manifold for liquid supply is placed at the rear end RE, to thereby supply liquid into the respective grooves 6 from the rear end RE side. Materials and the like used as the piezoelectric material 10 and the low-permittivity material 9 are similar to those of the first embodiment, and hence description thereof is omitted.

Third Embodiment

FIGS. 6A, 6B, 6C, 6D, 6E, and 6F are explanatory diagrams illustrating a manufacturing method for a liquid jet head according to a third embodiment of the present invention. The same portions and the portions having the same function are denoted by the same reference symbols.

Figure 6A:
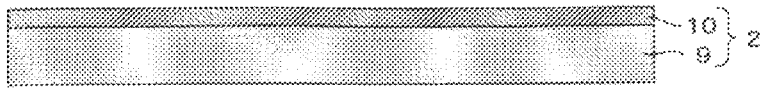
FIGS. 6A, 6B, 6C, 6D, 6E, and 6F are explanatory diagrams illustrating a manufacturing method for a liquid jet head according to a third embodiment of the present invention.

FIG. 6A illustrates a cross-section of the actuator substrate 2 which has undergone a first bonding step of bonding a piezoelectric substrate made of the piezoelectric material 10 on a surface of a low-permittivity substrate made of the low-permittivity material 9 which is lower in permittivity than the piezoelectric material 10. A machinable ceramics is used as the low-permittivity material 9, and a PZT ceramics is used as the piezoelectric material 10. Both the materials are pasted and bonded to each other by an adhesive. The piezoelectric substrate has a thickness corresponding to a half of the depth of the grooves 6 to be formed later. In this case, the piezoelectric substrate having a thickness larger than the half of the depth of the grooves 6 may be bonded on the low-permittivity substrate, and then may be ground so as to have the thickness corresponding to the half of the depth of the grooves 6. The thickness of the piezoelectric substrate is large, and hence it is easy to handle the substrate when pasting on the low-permittivity substrate. In a case of forming the grooves having a depth of, for example, 300 μm, the thickness of the piezoelectric substrate is set to 150 μm. The machinable ceramics is the low-permittivity material having a relative permittivity of 10 or less, and excellent in machinability. For example, Macerite, Macor, Photoveel, and Shapal (which are all registered trademarks) may be used. Further, as the low-permittivity material 9, an aluminum nitride or an aluminum nitride-based machinable ceramics may be used. Each of the materials has a relative permittivity of 10 or less, and is a highly thermal conductive material. Thus, it is possible to effectively cool the piezoelectric material 10 which generates heat at the time of driving.

Figure 6B:
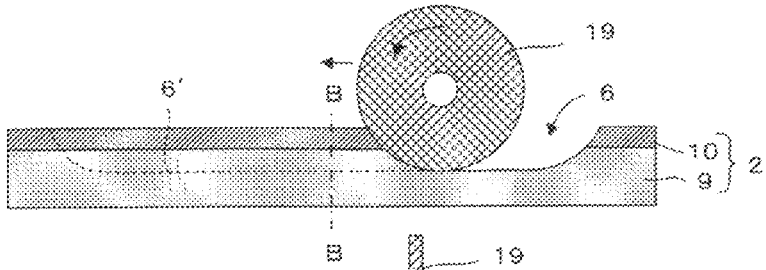
Figure 6C:
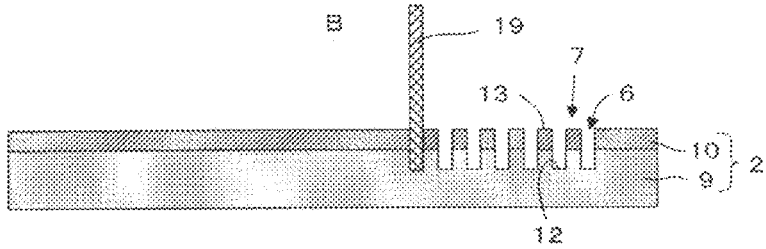

FIGS. 6B and 6C illustrate a groove forming step of forming a plurality of parallelly aligned grooves by cutting the surface of the actuator substrate 2. FIG. 6B is a vertical sectional schematic view taken along a direction of the grooves 6 of the actuator substrate 2, and FIG. 6C is a vertical sectional schematic view taken along a direction orthogonal to the grooves 6. A rotating dicing blade 19 is lowered onto the surface of the actuator substrate 2, and then moved to form the plurality of parallelly aligned grooves 6. Each of the partition walls 7 separating the adjacent grooves 6 is made of the piezoelectric material 10 on the top surface 13 side situated above substantially half the height from the bottom surface 12 of the groove 6 to the top surface 13 of the partition walls 7, and is made of the low-permittivity material 9 on the bottom surface 12 side situated below substantially half the height. The depth of the grooves 6, i.e., the height from the bottom surface 12 to the top surface 13 is set to 300 μm to 360 μm, and the grooves 6 constituting 100 or more channels are formed. In this embodiment, a large number of the actuator substrates 2 are formed simultaneously. As illustrated in FIG. 6B, the grooves 6 are cut along a broken line 6' like a ship's bottom, and then are divided at a center portion BB after performing a second bonding step described below, to thereby obtain the plurality of liquid jet heads 1.

Figure 6D:
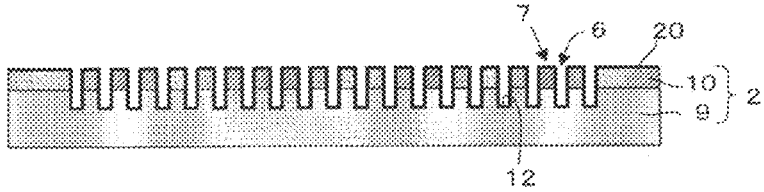

FIG. 6D is a sectional schematic view of the actuator substrate 2 which has undergone a conductive film forming step of forming a conductive film 20 on the surface of the actuator substrate 2 and both the side surfaces of each partition wall 7. The conductive film 20 can be formed of a metal material such as aluminum, gold, Cr, or Ni by sputtering, deposition, plating, or the like.

Figure 6E:
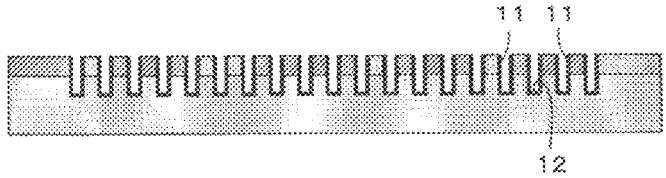

FIG. 6E is a sectional schematic view of the actuator substrate 2 which has undergone an electrode forming step of patterning the conductive film 20 and forming the drive electrodes 11 from the conductive film 20 formed on each partition wall 7. A pattern of a photosensitive resin film is formed by photolithography, and the conductive film 20 is removed by etching. Further, it is possible to form a pattern of the conductive film 20 by a laser beam and a lift-off method described below instead of by the photolithography and the etching processing. Note that, in this embodiment, the drive electrodes 11 formed on the side surfaces of both the partition walls 7 forming the groove 6 are connected to each other at the bottom surface 12 of the groove 6. This is an electrode configuration suitable for the three-cycle drive described in the first embodiment with reference to FIG. 3B. In a case of adopting the electrode configuration for the one-cycle drive described with reference to FIG. 3A, the drive electrodes 11 may be separated from each other by cutting the conductive film 20 formed on the bottom surface 12 of the groove 6 at the center portion of the bottom surface 12 by the laser beam or a dicing blade having a thickness smaller than the width of the groove 6.

Figure 6F:
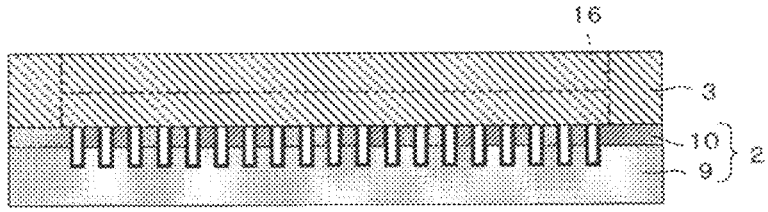

FIG. 6F is a sectional schematic view of the liquid jet head 1 which has undergone the second bonding step of bonding the cover plate 3 onto the surface of the actuator substrate 2. The cover plate 3 is bonded onto the surface of the actuator substrate 2 by using an adhesive, and the channels for liquid discharge are formed. After that, the bonded substrate is separated into parts, and the nozzle plate 4 is bonded at the front end FE of each part of the substrate, to thereby obtain the liquid jet head 1.

As described above, it is unnecessary to pattern the drive electrodes 11 on the upper half of the partition wall 7 with high accuracy, and hence the conductive film forming step of forming the conductive film 20 by depositing the conductive material, and the electrode forming step of forming the pattern of the conductive film 20 can be performed by an extremely simple method.

Fourth Embodiment

FIGS. 7A, 7B, 7C, and 7D are explanatory diagrams illustrating a manufacturing method for the liquid jet head 1 according to a fourth embodiment of the present invention. In this embodiment, the conductive film forming step is performed by an oblique deposition step using oblique deposition. The first bonding step and the groove forming step are similar to those of the third embodiment, and hence description thereof is omitted.

Figure 7A:
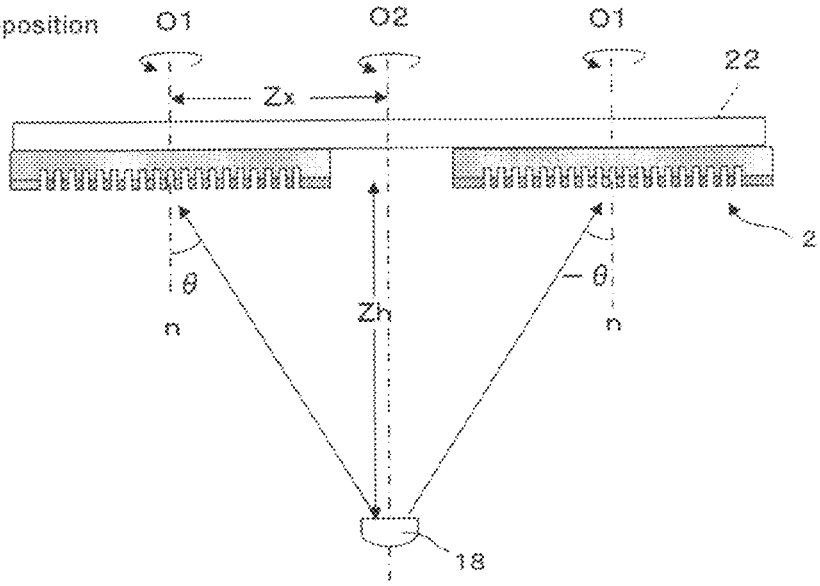
FIGS. 7A, 7B, 7C, and 7D are explanatory diagrams illustrating a manufacturing method for a liquid jet head according to a fourth embodiment of the present invention.
Figure 7B:
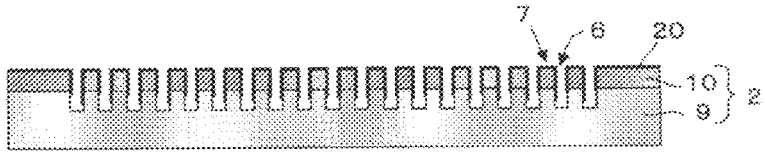

FIGS. 7A and 7B are explanatory diagrams illustrating the oblique deposition step of depositing the conductive material obliquely on the surface of the actuator substrate 2. FIG. 7A is a schematic view illustrating oblique deposition, and FIG. 7B is a sectional schematic view of the actuator substrate 2 which has undergone the oblique deposition.

A depositing device includes an evaporation source 18 and a holder 22 which are accommodated inside a chamber (not shown). The holder 22 holds the actuator substrate 2 on the evaporation source 18 side. The holder 22 holds the actuator substrate 2 so as to be able to rotate the same about a rotation axis O1, and is configured to be rotatable about a perpendicular direction of the evaporation source 18 as a rotation axis O2.

First, the actuator substrate 2 is set on the holder 22 (at a position on the left side of FIG. 7A) so that the direction of the evaporation source 18 is substantially orthogonal to a longitudinal direction of the grooves 6 to form an inclination angle θ with respect to a normal n of the surface of the actuator substrate 2. (Assuming that a distance between the evaporation source 18 and the holder 22 is Zh and a distance between the rotation axis O2 and the rotation axis O1 of the actuator substrate 2 is Zx, tan(θ)=Zx/Zh is satisfied.) Next, while the holder 22 is rotated about the rotation axis O2, the conductive material is evaporated from the evaporation source 18 and deposited on the surface of the actuator substrate 2 and one side surface of each partition wall 7.

Next, the actuator substrate 2 is rotated about the rotation axis O1 by 180°, and the actuator substrate 2 is set on the holder 22 (at a position on the right side of FIG. 7A) so that the direction of the evaporation source 18 is substantially orthogonal to the direction of the grooves 6 to form an inclination angle −θ with respect to the normal n of the surface of the actuator substrate 2. Next, while the holder 22 is rotated about the rotation axis O2, the conductive material is evaporated from the evaporation source 18 and deposited on the surface of the actuator substrate 2 and the other side surface of each partition wall 7. The deposition angle θ is set based on the width of the groove 6 and the thickness of the piezoelectric material 10 so that the conductive material is deposited on at least all of the side surfaces of the piezoelectric material 10 forming the partition walls 7 in the drive region DR and extends across the side surfaces of the piezoelectric material 10 and the low-permittivity material 9. For example, in a case where the depth of the groove 6 is 300 μm, the width of the groove 6 is 75 μm, and an effective length in a direction orthogonal to the direction of the grooves 6 is 72 mm, Zh may be set to 60 cm and Zx may be set to 29 cm or less. In other words, it is possible to deposit the conductive material at a position deeper than substantially half the height of the partition wall 7 that is furthest away from the evaporation source 18. In this case, when the length of the actuator substrate 2 in the direction orthogonal to the direction of the grooves 6 is 10 cm, three actuator substrates 2 can be aligned between the rotation axes O1 and O2 and subjected to deposition simultaneously. That is, it is possible to remarkably improve productivity of the oblique deposition in comparison with a conventional method. Note that, aluminum is used as the conductive material. Other than the aluminum, another metal such as gold and chromium may be used.

Here, a general condition of the oblique deposition is as follows, the oblique deposition being performed in such a way that the conductive film 20 is deposited at least on the entire side surfaces of the partition walls 7 made of the piezoelectric material 10 and the conductive material is not deposited on the bottom surfaces 12 of the grooves 6. A condition for performing deposition from the top surface of each partition wall 7 to ½ of the height of the partition wall 7 is expressed by the following equation:

$$\tan(\theta 1)=2w/h \quad (1),$$

where the width of the groove 6 is w, the height of the partition wall 7 (depth of the groove 6) is h, the height of the boundary between the piezoelectric material 10 and the low-permittivity material 9 of the partition wall 7 is h/2, and the oblique deposition angle (inclination angle) is θ.

A condition for performing deposition on the entire side surfaces of each partition wall 7 and for not performing deposition on the bottom surface 12 of each groove 6 is expressed by the following equation:

$$\tan(\theta 2)=w/h \quad (2).$$

Therefore, the actuator substrate 2 only needs to be placed at a position at which the oblique deposition angle θ satisfies the following expression (3) with respect to the evaporation source 18.

$$\theta 2<\theta<1=\tan^{-1}(w/h)<\theta<\tan^{-1}(2w/h) \quad (3)$$

For example, when the width w of the groove 6 is 75 μm and the height h of the partition wall 7 is 360 μm, the oblique deposition angle θ ranges from 12° to 23°. For example, when Zh expressed in FIG. 7A is 60 cm, the position Zx of the holder 22, at which the oblique deposition is possible, is in a range of from 12.5 cm to 25 cm, and the actuator substrate 2 only needs to be placed within this range.

FIG. 7B is a sectional schematic view of the actuator substrate 2 which has undergone the oblique deposition of the conductive material. The conductive material is deposited on the surface of the actuator substrate 2 and the top surface and both the side surfaces of each partition wall 7, to thereby form the conductive film 20. At the left end portion of the actuator substrate 2, the conductive film 20 on the partition wall 7 is formed deeper toward the bottom surface 12 on the left side surface than on the right side surface. At the right end portion of the actuator substrate 2, the conductive film 20 on the partition wall 7 is formed deeper toward the bottom surface 12 on the right side surface than on the left side surface.

Figure 7C:
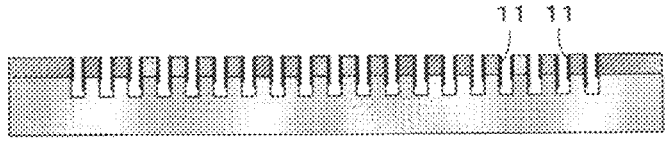
Figure 7D:
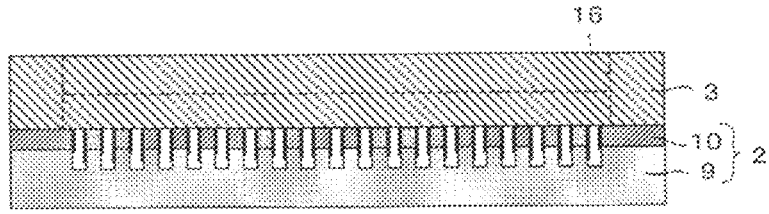

FIG. 7C is a sectional schematic view of the actuator substrate 2 which has undergone the electrode forming step of patterning the conductive film 20 and forming the drive electrodes 11 from the conductive film 20 formed on each partition wall 7. A pattern of a photosensitive resin film is formed by photolithography, and the conductive film 20 is removed by etching. Further, the conductive film 20 formed on both the side surfaces of the partition wall 7 may be electrically separated into parts by a laser beam and surface grinding instead of by a photo process. FIG. 7D is a sectional schematic view of the liquid jet head 1 which has undergone the second bonding step of bonding the cover plate 3 onto the surface of the actuator substrate 2. The cover plate 3 is bonded onto the surface of the actuator substrate 2 by using an adhesive, and the channels for liquid discharge are formed. After that, the bonded substrate is separated into parts, and the nozzle plate 4 is bonded at the front end FE of each part of the substrate, to thereby obtain the liquid jet head 1.

In the liquid jet head 1 manufactured as described above, even if the drive electrodes 11 vary in width in the direction of the bottom surface 12 of the groove 6, the piezoelectric material 10 exhibiting the electrostrictive effect is the same in every partition wall 7. Thus, the respective partition walls 7 have a uniform deformation drive amount, with the result that the variations in liquid droplet discharge rate among the channels are reduced. Further, the low-permittivity material 9 is interposed between one partition wall 7 and another adjacent partition wall 7, and hence capacitive coupling between the partition walls 7 is reduced, with the result that it is possible to prevent such a situation that the drive signal leaks to the adjacent partition wall to fluctuate liquid discharge characteristics of the adjacent nozzle. In addition, it is possible to electrically separate the drive electrodes 11 formed on both the side surfaces of each groove 6 in the oblique deposition step, and hence a step of cutting the electrodes deposited on the bottom surfaces 12 of the grooves 6 is unnecessary, which allows extremely easy formation of the drive electrodes 11. Further, the deposition angle θ at the time of oblique deposition is remarkably moderated so that a depositable range is enlarged, and hence it is possible to improve the productivity.

Fifth Embodiment

FIGS. 8A, 8B, 8C, 8D, and 8E and FIGS. 9A, 9B, 9C, and 9D are explanatory diagrams illustrating a manufacturing method for a liquid jet head according to a fifth embodiment of the present invention. The fifth embodiment is different from the fourth embodiment in that the conductive film 20 formed by the oblique deposition is patterned by the lift-off method, and the other steps are the same as those of the fourth embodiment.

Figure 8A:
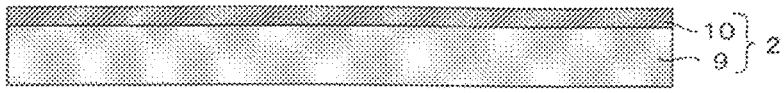
FIGS. 8A, 8B, 8C, 8D, and 8E are explanatory diagrams illustrating a manufacturing method for a liquid jet head according to a fifth embodiment of the present invention.

FIG. 8A is a sectional schematic view of the actuator substrate 2 which has undergone the first bonding step of bonding the piezoelectric substrate made of the piezoelectric material 10 on the surface of the low-permittivity substrate made of the low-permittivity material 9 which is lower in permittivity than the piezoelectric material 10. Materials and the like to be used have been described in the third embodiment.

Figure 8B:
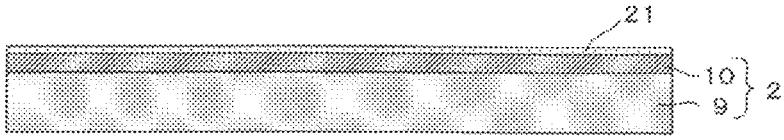
Figure 8C:
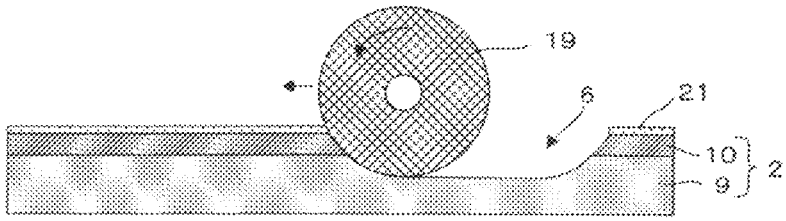
Figure 8D:
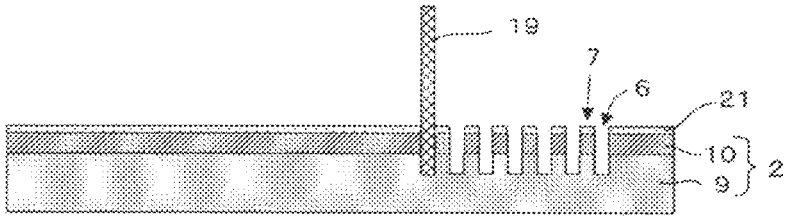

FIG. 8B is a sectional schematic view of the actuator substrate 2 which has undergone a photosensitive resin film forming step of forming a photosensitive resin film 21 on the surface of the actuator substrate 2. A resist sheet is used as the photosensitive resin film 21, and is pasted on the surface of the actuator substrate 2, to thereby form the photosensitive resin film 21. The photosensitive resin film 21 may be formed by applying a resist layer, instead of the resist sheet, on the surface of the actuator substrate 2 with a spinner or the like. FIGS. 8C and 8D illustrate the groove forming step in which the dicing blade 19 is lowered onto the surface of the actuator substrate 2, and then moved to form the plurality of parallelly aligned grooves 6. The groove forming step is similar to that of the third embodiment.

Figure 8E:
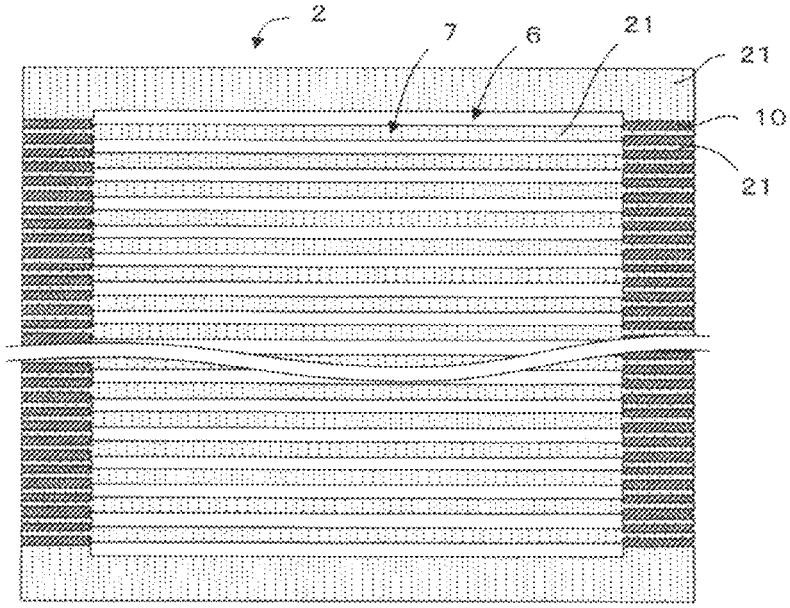

FIG. 8E is a top schematic view of the actuator substrate 2 which has undergone a pattern forming step of forming a pattern of the photosensitive resin film 21. The pattern of the photosensitive resin film 21 is formed by photolithography. In this case, the photosensitive resin film 21 is left in a region from which the conductive material to be deposited in the subsequent oblique deposition step is removed, and the photosensitive resin film 21 is removed from a region in which the conductive material is left. In the case of this embodiment, the photosensitive resin film 21 is left from the top surface 13 to the right and left end portions of each partition wall 7. Further, the photosensitive resin film 21 is removed from a region in which each groove 6 and the terminal electrode are formed, and the piezoelectric material 10 is exposed.

Figure 9A:
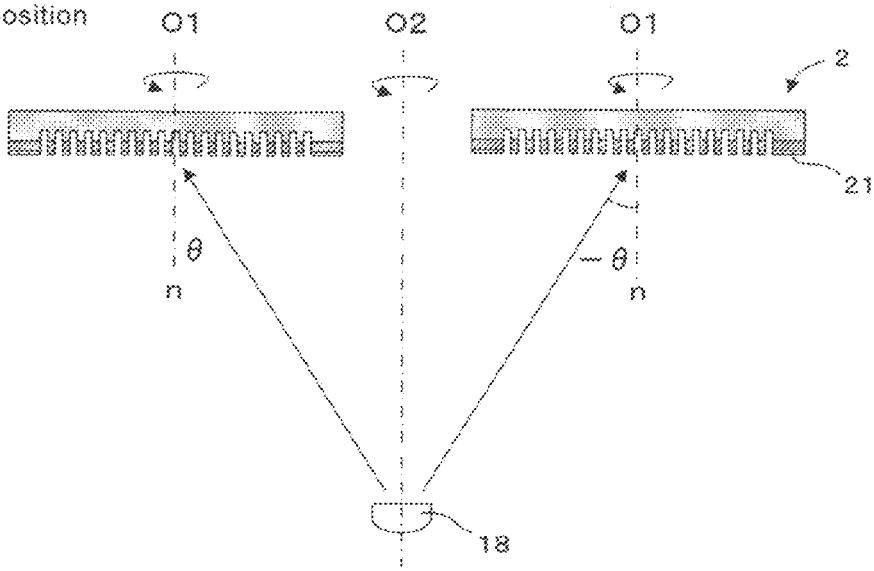
FIGS. 9A, 9B, 9C, and 9D are explanatory diagrams illustrating the manufacturing method for a liquid jet head according to the fifth embodiment of the present invention.
Figure 9B:
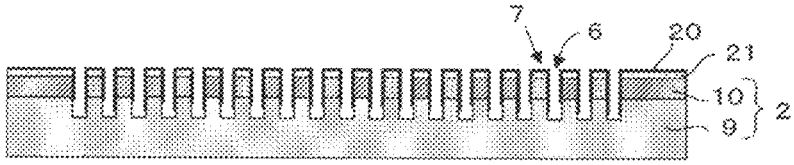

Next, FIGS. 9A and 9B are explanatory diagrams illustrating the oblique deposition step of depositing the conductive material obliquely on the surface of the actuator substrate 2. The oblique deposition step is similar to that of the third embodiment. As illustrated in FIG. 9B, the photosensitive resin film 21 is left on the top surface 13 of each partition wall 7, and the conductive film 20 is formed on the photosensitive resin film 21. Further, the conductive film 20 is formed on both the side surfaces of the partition wall 7 so as to overlap at least the piezoelectric material 10.

Figure 9C:
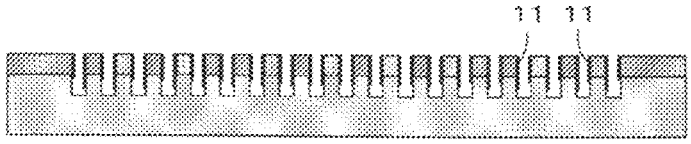
Figure 9D:
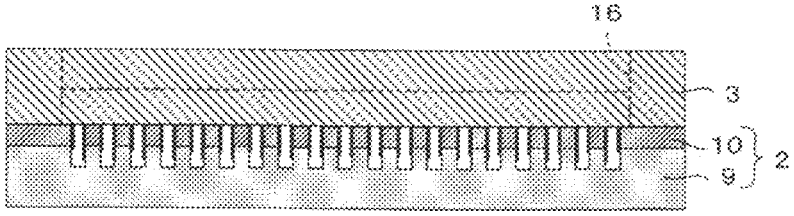

FIG. 9C is a sectional schematic view of the actuator substrate 2 which has undergone the electrode forming step of forming the electrodes by removing the photosensitive resin film 21 by the lift-off method. The photosensitive resin film 21 is removed so that the conductive film 20 is simultaneously removed. In this way, the conductive film 20 formed on both the side surfaces of the partition wall 7 is electrically separated into parts, to thereby form the drive electrodes 11. In addition, the terminal electrodes that are electrically connected to the respective drive electrodes 11 are formed at both the end portions of the surface of the actuator substrate 2, respectively. FIG. 9D is a sectional schematic view of the liquid jet head 1 in which the cover plate 3 is bonded onto the surface of the actuator substrate 2. The liquid jet head 1 is similar to that of the third embodiment.

As described above, the drive electrodes 11 are patterned by the lift-off method after being deposited by the oblique deposition, and hence it is possible to easily form an electrode pattern on both of the side surfaces of each partition wall 7 and the surface of the actuator substrate 2 by a simple step. In addition, even if the drive electrodes 11 vary in width in the depth direction of the grooves 6, the piezoelectric material 10 exhibiting the electrostrictive effect is the same in every partition wall 7, and hence the partition walls 7 exhibit a uniform deformation drive amount. Further, the low-permittivity material 9 is used, and hence the drive signal does not leak to the adjacent partition wall 7.

It is noted that the pattern forming step for the photosensitive resin film 21 may be performed prior to the groove forming step, and the plurality of grooves 6 may be formed along the pattern of the photosensitive resin film 21. Further, the oblique deposition step for the conductive material is not limited to the methods illustrated in FIGS. 7A, 7B, 7C, and 7D and FIGS. 9A, 9B, 9C, and 9D. For example, there may be adopted such a configuration that a narrow slit is provided between the evaporation source 18 and the actuator substrate 2, and only the conductive material injected at a specific angle is deposited on the actuator substrate 2. Further, the lift-off method for the conductive film 20 is not limited to the case of forming the conductive film 20 by the oblique deposition. Needless to say, the lift-off method is applicable to the case of forming the conductive film by sputtering in the third embodiment and another case of forming the conductive film 20.

Sixth Embodiment

Figure 10:
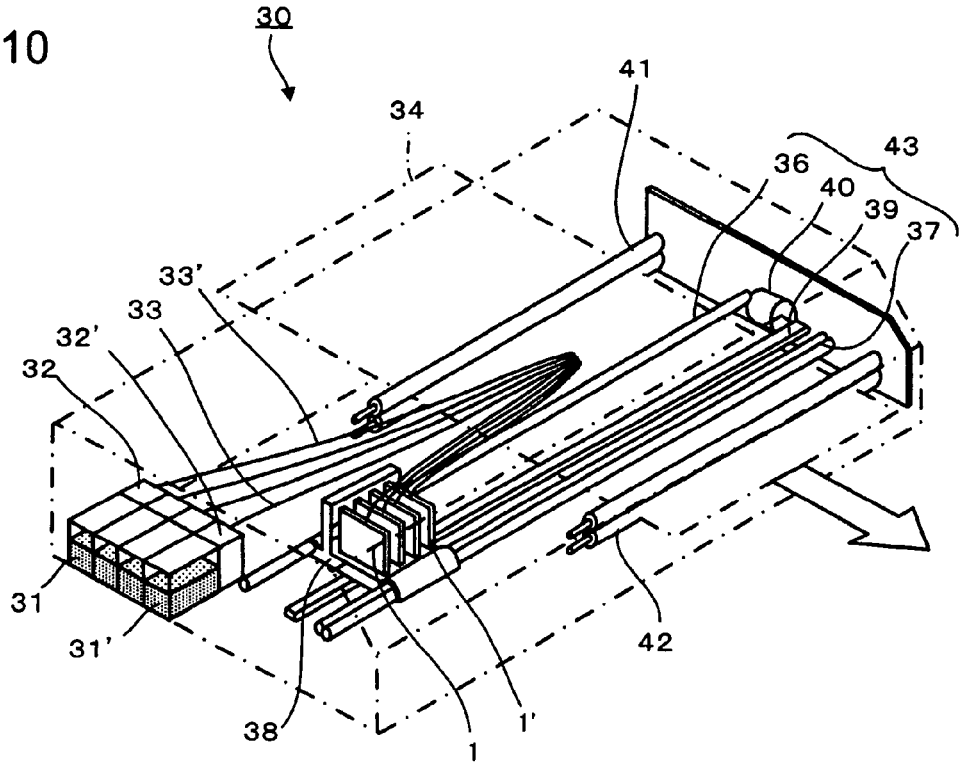
FIG. 10 is an explanatory diagram illustrating a manufacturing method for a liquid jet head according to a sixth embodiment of the present invention.
Figure 11:
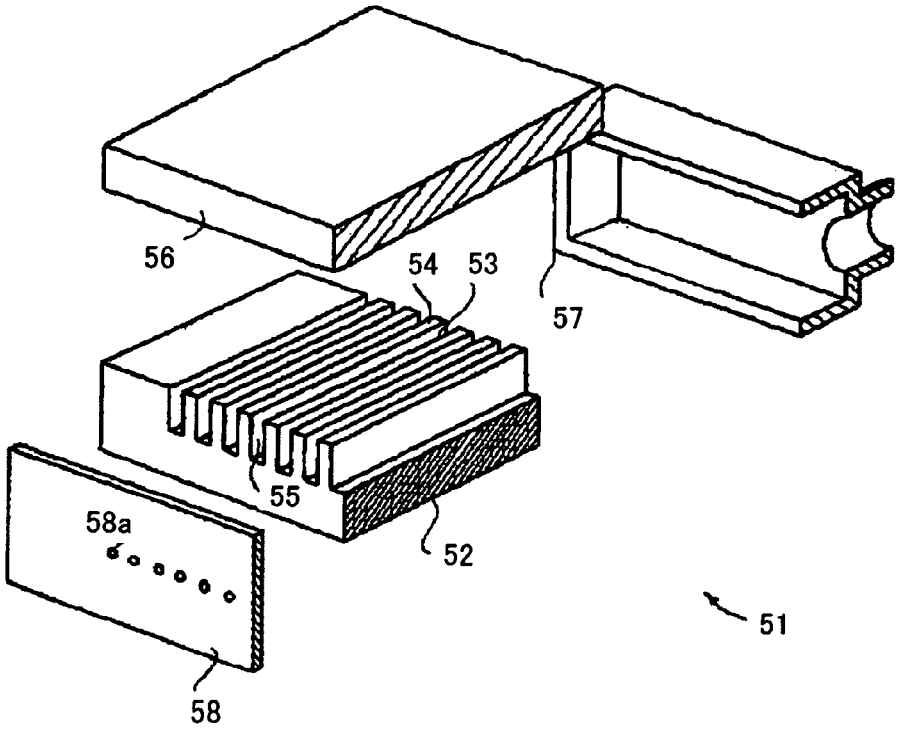
PRIOR ART FIG.11
FIG. 11 is an exploded perspective view of a conventionally known ink jet head.

FIG. 10 is a schematic perspective view of a liquid jet apparatus 30 according to a sixth embodiment of the present invention.

The liquid jet apparatus 30 includes a moving mechanism 43 for reciprocating liquid jet heads 1 and 1' according to the present invention described above, liquid supply tubes 33 and 33' for supplying liquid to the liquid jet heads 1 and 1', and liquid tanks 31 and 31' for supplying liquid to the liquid supply tubes 33 and 33'. Each of the liquid jet heads 1 and 1' is formed of the liquid jet head 1 according to the present invention. That is, each of the liquid j et heads 1 and 1' includes: an actuator substrate including a plurality of grooves aligned parallelly in a surface thereof, and partition walls separating the adjacent grooves; a cover plate bonded onto the surface of the actuator substrate, for covering the grooves; and a nozzle plate including nozzles communicating to the grooves, the nozzle plate being bonded onto an end surface of the actuator substrate. The actuator substrate includes a drive region for driving the partition walls so as to deform the same, and for causing liquid filling the grooves to jet from the nozzles. Each partition wall in the drive region is made of a piezoelectric material on a top surface side situated above substantially half a height from a bottom surface of the groove to the top surface of the partition wall, and made of a low-permittivity material, which is lower in permittivity than the piezoelectric material, on the bottom surface side situated below substantially half the height.

A specific description is made in the as follows. The liquid jet apparatus 30 includes a pair of conveying means 41 and 42 for conveying a recording medium 34 such as paper in a main scanning direction, the liquid jet heads 1 and 1' for discharging liquid toward the recording medium 34, pumps 32 and 32' for pressing liquid stored in the liquid tanks 31 and 31' into the liquid supply tubes 33 and 33' for supply, and the moving mechanism 43 for causing the liquid jet head 1 to scan in a sub-scanning direction which is orthogonal to the main scanning direction.

Each of the pair of conveying means 41 and 42 includes a grid roller and a pinch roller which extend in the sub-scanning direction and which rotate with roller surfaces thereof being in contact with each other. A motor (not shown) axially rotates the grid rollers and the pinch rollers to convey, in the main scanning direction, the recording medium 34 sandwiched therebetween. The moving mechanism 43 includes a pair of guide rails 36 and 37 which extend in the sub-scanning direction, a carriage unit 38 which is slidable along the pair of guide rails 36 and 37, an endless belt 39 which is coupled to the carriage unit 38 for moving the carriage unit 38 in the sub-scanning direction, and a motor 40 for rotating the endless belt 39 via a pulley (not shown).

The carriage unit 38 has the plurality of liquid jet heads 1 and 1' mounted thereon for discharging, for example, four kinds of liquid droplets: yellow; magenta; cyan; and black. The liquid tanks 31 and 31' store liquid of corresponding colors, and supply the liquid via the pumps 32 and 32' and the liquid supply tubes 33 and 33' to the liquid jet heads 1 and 1'. The respective liquid jet heads 1 and 1' discharge liquid droplets of the respective colors according to a drive signal. By controlling discharge timing of liquid from the liquid jet heads 1 and 1', rotation of the motor 40 for driving the carriage unit 38, and conveying speed of the recording medium 34, an arbitrary pattern may be recorded on the recording medium 34.

With this configuration, the liquid discharge characteristics of the liquid jet head 1 are equalized in the respective channels. In addition, the drive signal for driving the channels does not leak to the adjacent channels, and hence high-quality recording of liquid can be performed on the recording medium. Further, it is unnecessary to manufacture the liquid jet head 1 through complicated steps, which may simplify the manufacturing steps and may contribute to cost reduction of the apparatus.

What is claimed is:

1. A liquid jet head, comprising:

an actuator substrate comprising: a plurality of grooves aligned in parallel to each other in a surface of the actuator substrate; partition walls separating the plurality of grooves from each other, each of the partition walls having opposite side surfaces each confronting a side surface of an adjacent partition wall; and drive electrodes disposed on the confronting side surfaces of the partition walls to form a plurality of pairs of confronting drive electrodes, the drive electrodes of each pair of confronting drive electrodes being disposed so that they are not connected to each other, the drive electrodes not being formed on bottom surface of the grooves;

a cover plate bonded onto the surface of the actuator substrate so as to cover the plurality of grooves; and a nozzle plate comprising nozzles communicating with respective ones of the plurality of grooves, the nozzle plate being bonded onto an end surface of the actuator substrate;

wherein the actuator substrate comprises a drive region for driving the drive electrodes so as to deform the partition walls to cause liquid filling the plurality of grooves to jet from the nozzles;

wherein, in the drive region, each of the partition walls is made of a piezoelectric material on a top surface side situated above substantially half a height from the bottom surface of each of the plurality of grooves to a top surface of each of the partition walls, and is made of a low-permittivity material, which is lower in permittivity than the piezoelectric material, on a bottom surface side situated below substantially half the height; and wherein, in the drive region, each of the drive electrodes is placed so as to extend across each side surface of each of the partition walls made of the piezoelectric material and each side surface of each of the partition walls made of the low-permittivity material.

2. A liquid jet head according to claim 1; wherein the drive electrodes disposed on both side surfaces of each of the partition walls are uneven on both ends of the actuator substrate and are even in a middle portion of the actuator substrate, and a length of each of the electrodes on side surfaces of each of the partition walls gradually changes from one end of the actuator substrate to the other end of the actuator substrate.

3. A liquid jet head according to claim 1; wherein the actuator substrate has a double-layer structure made of the low-permittivity material and the piezoelectric material.

4. A liquid jet head according to claim 1; wherein the low-permittivity material is higher in thermal conductivity than the piezoelectric material.

5. A liquid jet head according to claim 1; wherein the low-permittivity material is lower in mechanical rigidity than the piezoelectric material.

6. A liquid jet head according to claim 1; wherein the low-permittivity material comprises one of a machinable ceramics and a resin material.

7. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

8. A liquid jet head according to claim 1; wherein the confronting drive electrodes of each pair extends into the corresponding one of the plurality of grooves and are separated by a gap therebetween defined in part by the bottom surface of the corresponding one groove.

* * * * *